United States Patent [19]

Moehlenpah et al.

[11] 4,351,465

[45] Sep. 28, 1982

[54] APPARATUS FOR END-PLATING RAILROAD TIES

[75] Inventors: Walter G. Moehlenpah, Ladue; Gordon E. Matlock, Sullivan, both of Mo.

[73] Assignee: Moehlenpah Industries, Inc., St. Louis, Mo.

[21] Appl. No.: 186,255

[22] Filed: Sep. 11, 1980

[51] Int. Cl.[3] ..... B25C 7/00

[52] U.S. Cl. ..... 227/7; 100/295; 100/913; 198/456; 198/751; 198/774; 227/100; 227/150; 227/153

[58] Field of Search ..... 227/1, 5, 6, 7, 99, 227/100, 101, 150, 152, 153; 198/456, 751, 774, 777; 100/215, 295, 913; 269/258, 910

[56] References Cited

U.S. PATENT DOCUMENTS

| | | | |
|---|---|---|---|
| 2,636,433 | 4/1953 | Wennberg | 100/295 X |
| 2,845,828 | 8/1958 | Thomeczek | 82/31 |
| 3,419,205 | 12/1968 | Jureit et al. | 227/152 |
| 3,479,734 | 11/1969 | Groat | 227/1 X |
| 3,540,107 | 11/1970 | Jureit et al. | 29/155 |
| 3,603,248 | 9/1971 | Nouel | 100/218 |
| 3,715,820 | 2/1973 | Hentschel | 100/295 X |
| 3,866,897 | 2/1975 | Whalen | 269/87.2 |
| 3,947,011 | 3/1976 | Tsuyama | 269/249 |
| 4,254,894 | 3/1981 | Cheak | 227/152 X |

*Primary Examiner*—Howard N. Goldberg
*Assistant Examiner*—Fred A. Silverberg
*Attorney, Agent, or Firm*—Senniger, Powers, Leavitt and Roedel

[57] ABSTRACT

Apparatus for pressing nailing plates or the like into opposite ends of elongate members, such as wooden railroad ties, thereby to end-plate the ties. The apparatus comprises a press having upper and lower platens engageable with the top and bottom faces of a tie adjacent the ends thereof. The lower platens are movable through an upstroke for raising the tie while generally horizontal from a lowered position to an elevated position and for pressing the tie against the upper platens thereby to apply a vertical compressing force to the tie adjacent the ends thereof, and a downstroke for lowering the tie. Side platens are engageable with opposite side faces of the tie adjacent the ends thereof when the tie is in its elevated position. The side platens are movable toward and away from one another whereby a horizontal compressing force can be applied to and removed from the opposite side faces of the tie adjacent the ends thereof. A pair of end platens are engageable with nailing plates on opposite ends of the tie for pressing the nailing plates into the ends of the tie when the tie is elevated and while it is being compressed by the upper, lower and side platens.

28 Claims, 33 Drawing Figures

APPARATUS FOR END-PLATING RAILROAD TIES

BACKGROUND OF THE INVENTION

This invention relates to apparatus for driving nailing plates into the ends of elongate members, such as railroad ties, for the purpose of avoiding or at least minimizing end-splitting and cracking of the ties.

Railroad ties are typically cut from freshly felled trees while the timber is still relatively green. Before being treated with creosote or other wood preservative, the ties are generally permitted to season or dry out for several (e.g., six) months during which time the ties tend to split or crack, particularly at the ends of the ties. If sufficiently large cracks develop, the tie may become unsuitable for use except as for scrap. This of course can be quite costly in terms of low revenue.

There have been attempts to remedy this problem by "end-plating" split railroad ties, that is, by compressing the ties to close the cracks therein and then pressing nailing plates into the ends of the ties to hold the cracks closed. However, prior apparatus have proved unsatisfactory in many respects. For example, the rate at which ties can be end-plated by the apparatus is relatively slow.

U.S. Pat. Nos. 3,419,205 and 3,540,107 show relevant apparatus and method for end-plating ties.

SUMMARY OF THE INVENTION

Among the several objects of this invention may be noted the provision of improved apparatus for "end-plating" elongate members, such as railroad ties; the provision of such apparatus which is adapted to end-plate railroad ties at a relatively high rate of speed; the provision of such apparatus which is relatively easy and safe to operate; the provision of such apparatus which is adapted to end-plate railroad ties quickly and efficiently despite the fact that the ends of the railroad ties may be cut at oblique angles; and the provision of such apparatus which is reliable in operation and durable.

Generally, apparatus of the present invention is operable for pressing nailing plates or the like in opposite ends of elongate members, such as wooden railroad ties, thereby to end-plate the ties. The apparatus comprises a press having upper and lower platen means engageable with the top and bottom faces of a tie adjacent the ends thereof, the lower platen means being movable through an upstroke for raising the tie while generally horizontal from a lowered position to an elevated position and for pressing the tie against said upper platen means thereby to apply a vertical compressing force to the tie adjacent the ends thereof, and a downstroke for lowering the tie. Side platen means are engageable with opposite side faces of the tie adjacent the ends thereof when the tie is in its elevated position, the side platen means being movable toward and away from one another whereby a horizontal compressing force can be applied to and removed from opposite side faces of the tie adjacent the ends thereof. A pair of end platens are engageable with the nailing plates on opposite ends of the tie for pressing the nailing plates into the ends of the tie when the tie is in its elevated position and while the compressing forces are being applied to the tie by the upper, lower and side platen means. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
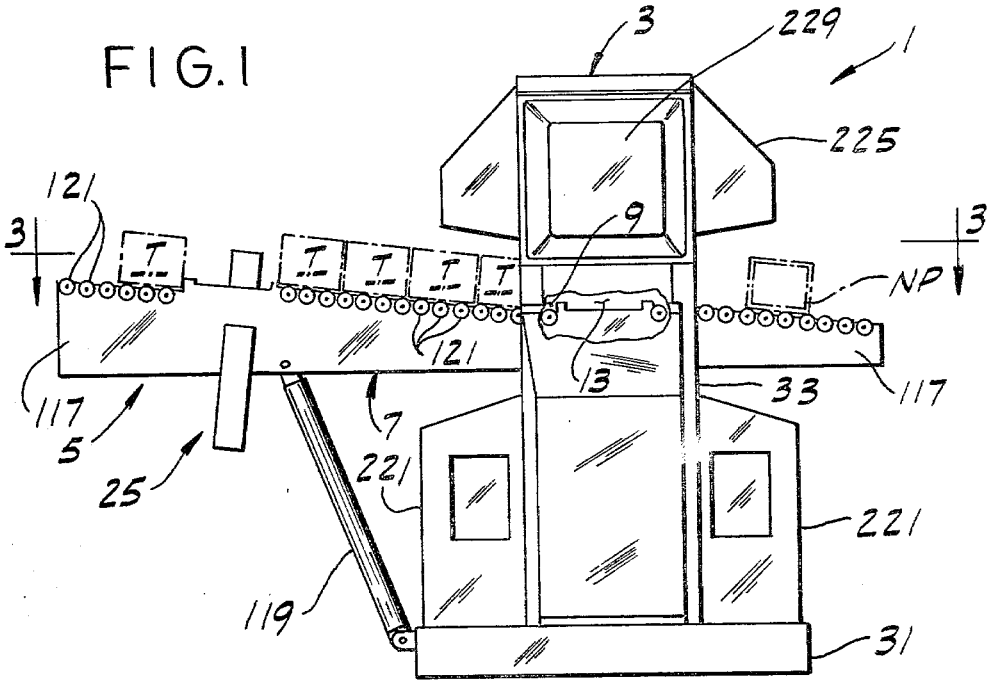
FIG. 1 is a side elevation of end-plating apparatus of the present invention.
Figure 2:
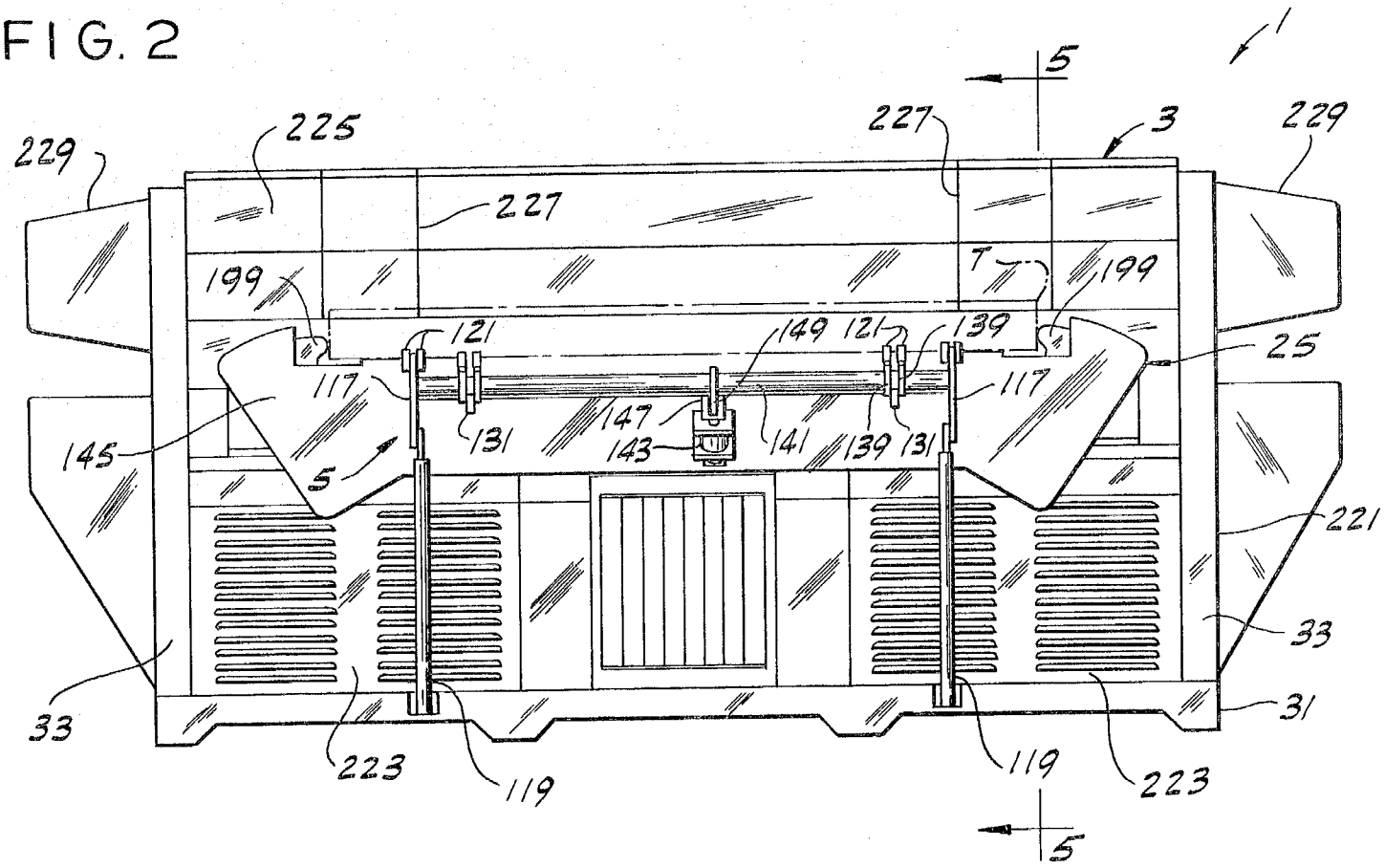
FIG. 2 is a front elevation of the end-plating apparatus of FIG. 1.
Figure 3:
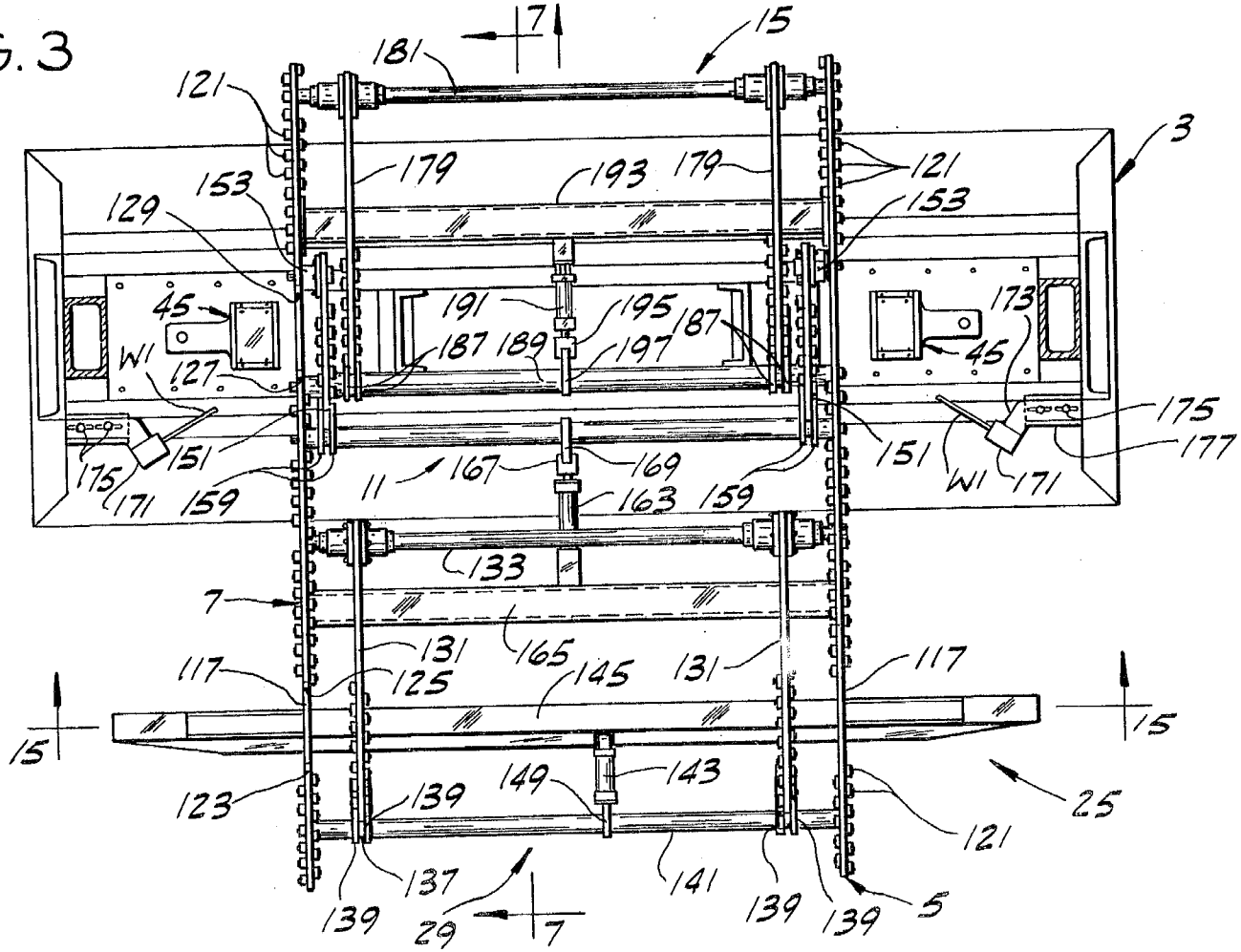
FIG. 3 is a horizontal section on line 3—3 of FIG. 1.

Referring now to the drawings, particularly to FIGS. 1–3, apparatus of the present invention, designated in its entirety by the reference numeral 1, is operable to drive nailing plates NP or the like into the ends of elongate members, such as wood railroad ties T, thereby to "end-plate" the ties to avoid or at least reduce splitting of the ties. The apparatus comprises a press, generally indicated at 3, and conveyor apparatus, generally indicated at 5, for conveying the ties forward (from left to right as viewed in FIG. 1) one after another and in a generally horizontal position extending transversely of the direction of conveyance to, through and out of press 3. This conveyor apparatus 5 includes infeed conveyor means 7 for conveying the ties forward to a first station, constituting a feed station 9, adjacent the press, means indicated generally at 11 for feeding the ties forward one at a time from the feed station to an end-plating station 13 in the press, and outfeed conveyor means 15 for conveying an end-plated tie from the press prior to the next tie being fed from the feed station to the end-plating station. The press 3 has upper and lower platen means designated 17 and 19, respectively, engageable with the top and bottom faces of a tie in the press. As will appear, the lower platen means is movable through an upstroke for raising the tie while generally horizontal from a lowered position to an elevated position and for pressing the tie against upper platen means 17 thereby to apply a vertical compressing force to the tie ends to close any horizontal cracks therein. The press also has side platen means, indicated generally at 21, engageable with opposite side faces of the tie adjacent the ends of the tie for applying a horizontal compressing force to the tie ends to close any vertical cracks therein, and a pair of end platen assemblies, each generally designated 23, engageable with nailing plates NP on opposite ends of the tie when the tie is in its elevated position for driving the plates into the tie ends while it is being compressed by the upper, lower and side platen means 17, 19, 21.

Apparatus 1 further comprises means generally designated 25 for centering the ties transversely with respect to the infeed conveyor means 7 as they are conveyed to feed station 9. To accomplish this, the ties are stopped as they are fed forward by the infeed conveyor means 7 at a dwell station 27 upstream of the feed station and transferred forward one at a time by means indicated generally at 29 from the dwell station to a centering station 30 where the tie is centered with respect to infeed conveyor means 7. Transfer means 29 is then operable to transfer the centered tie back onto the infeed conveyor means for conveyance to the feed station.

More specifically, press 3 comprises a base 31 and a main frame of generally inverted U-shape, having two sides 33 extending up from the base and a top 35. As shown best in FIG. 5, the top 35 of the press frame comprises a pair of opposing inwardly-opening channel beams 37 extending between the sides of the frame, and an upwardly-opening channel beam 39 secured (e.g., welded) to the upper flanges of beams 37. Together these three channel beams define an elongate open-bottom pressing chamber 41 extending substantially the entire width of the main frame. A pair of generally parallel outwardly-opening channels 43 extend between opposite sides of the frame below the pressing chamber.

Figure 4:
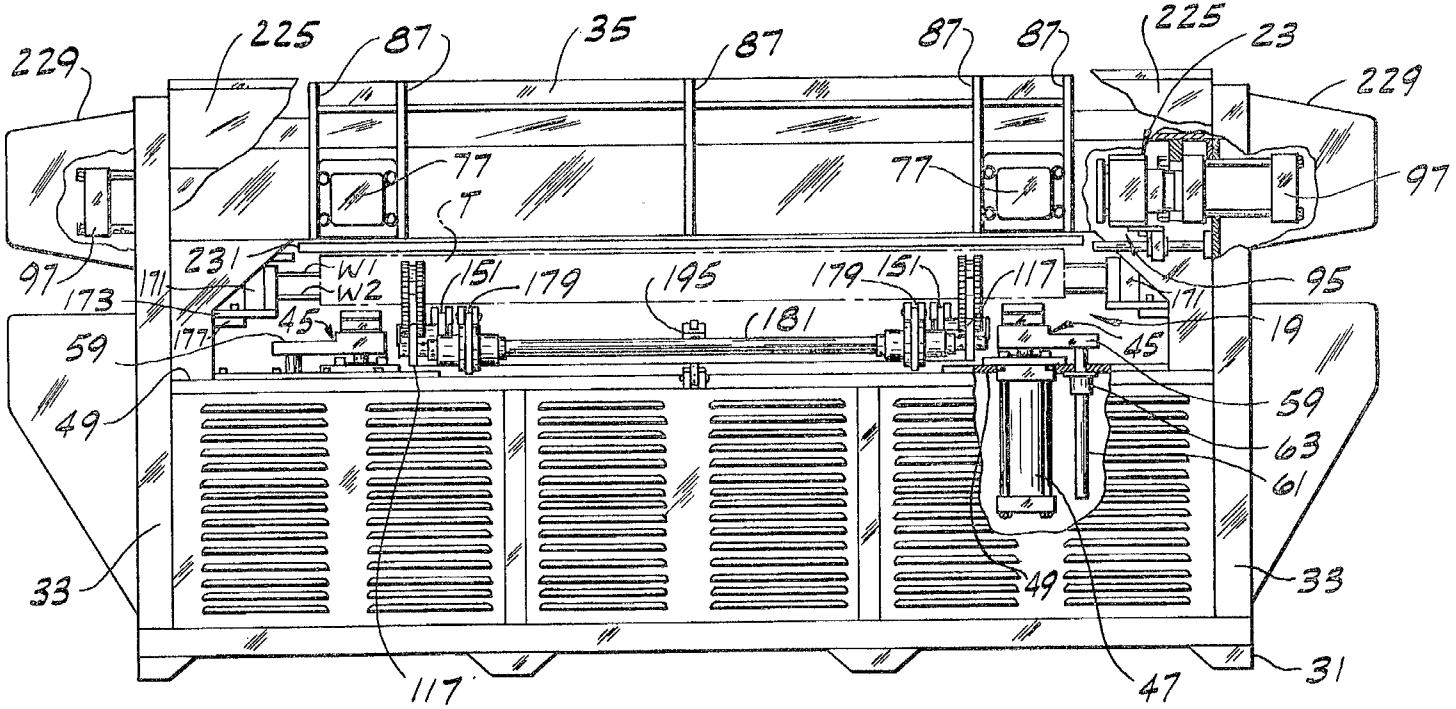
FIG. 4 is a rear elevation of FIG. 1 with parts broken away to illustrate details.
Figure 6:
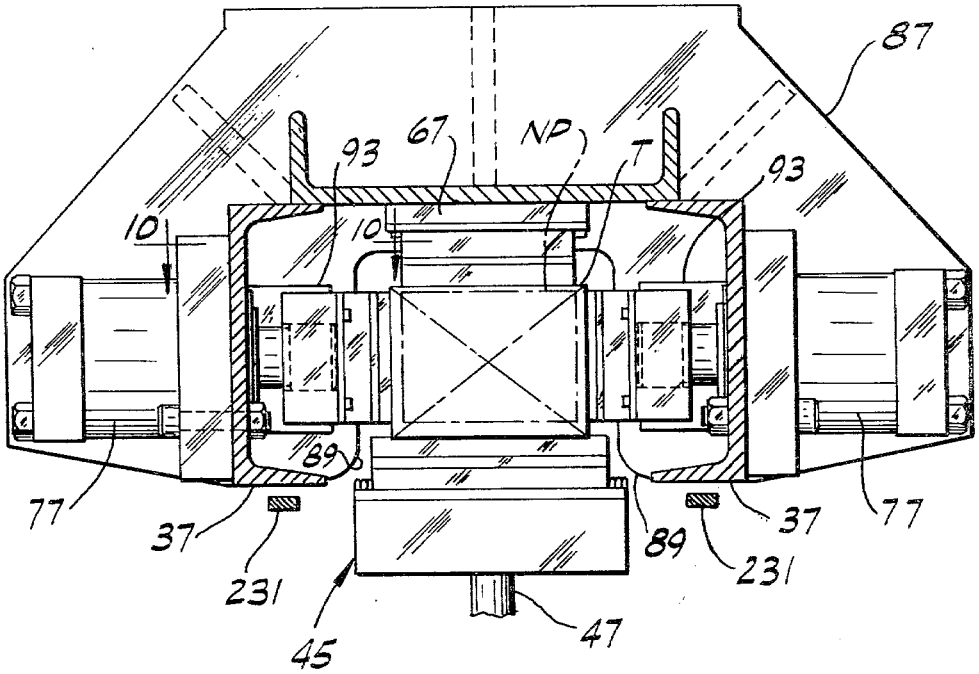
FIG. 6 is an enlarged portion of FIG. 6 showing upper, lower and side platens applying compressing forces to a tie.
Figure 12:
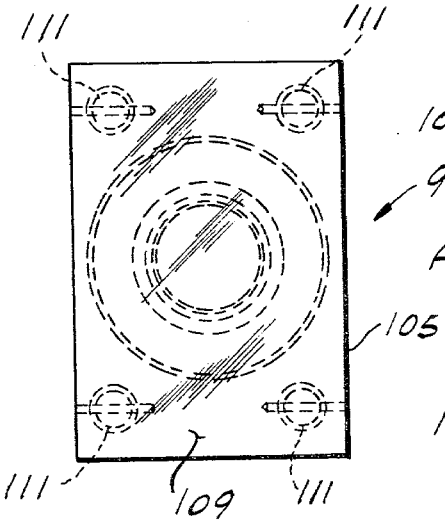
FIG. 12 is a left end elevation of FIG. 11.
Figure 7:
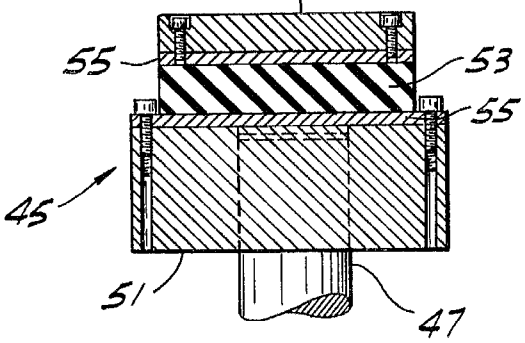
FIG. 7 is a sectional view illustrating the construction of a lower platen.

In accordance with the present invention, lower platen means 19 comprises a pair of lower platens, each generally designated 45, mounted adjacent opposite sides 33 of the press frame on the upper ends of cylinder rods of cylinders 47 (constituting first power means) for vertical movement in the central longitudinal vertical plane of the press between a lowered position (FIG. 4) in which the platens are spaced below the ends of a tie at the end-plating station 13, and a raised position (FIG. 6) in which the platens support a tie at an elevated position within pressing chamber 41. Each cylinder 47 is a double-acting cylinder of the tie-rod, flange-mounted type and is fastened (e.g., bolted) to a mounting plate 49 bearing on the top flanges of channels 43. As shown in FIG. 7, each of the two lower platens is of multi-piece construction, comprising a metal base member 51 recessed to receive the upper end of a respective cylinder rod, a resilient pad 53 of rubber or other appropriate material having metal facing plates 55 bonded (e.g., vulcanized) thereto, the lower facing plate being fastened to the base member 51, and a rectangular metal platen member 57, the latter being detachably secured to upper facing plate 55. Thus the various component parts of the platen may be readily disassembled when necessary (except for the facing plates 55 and pad 53 which are bonded together). The resilient pad adds flexibility to each platen, thereby enabling it more readily to conform to the bottom surface of a tie. The base member 51 of each lower platen is formed with an extension 59 (see FIG. 4) to which is attached a vertical guide rod 61 slidably received in a bearing 63 mounted on the underside of a respective mounting plate 49. This serves to maintain the platen in proper alignment (i.e., square) with respect to the machine as it reciprocates between its raised and lowered positions.

Figure 5:
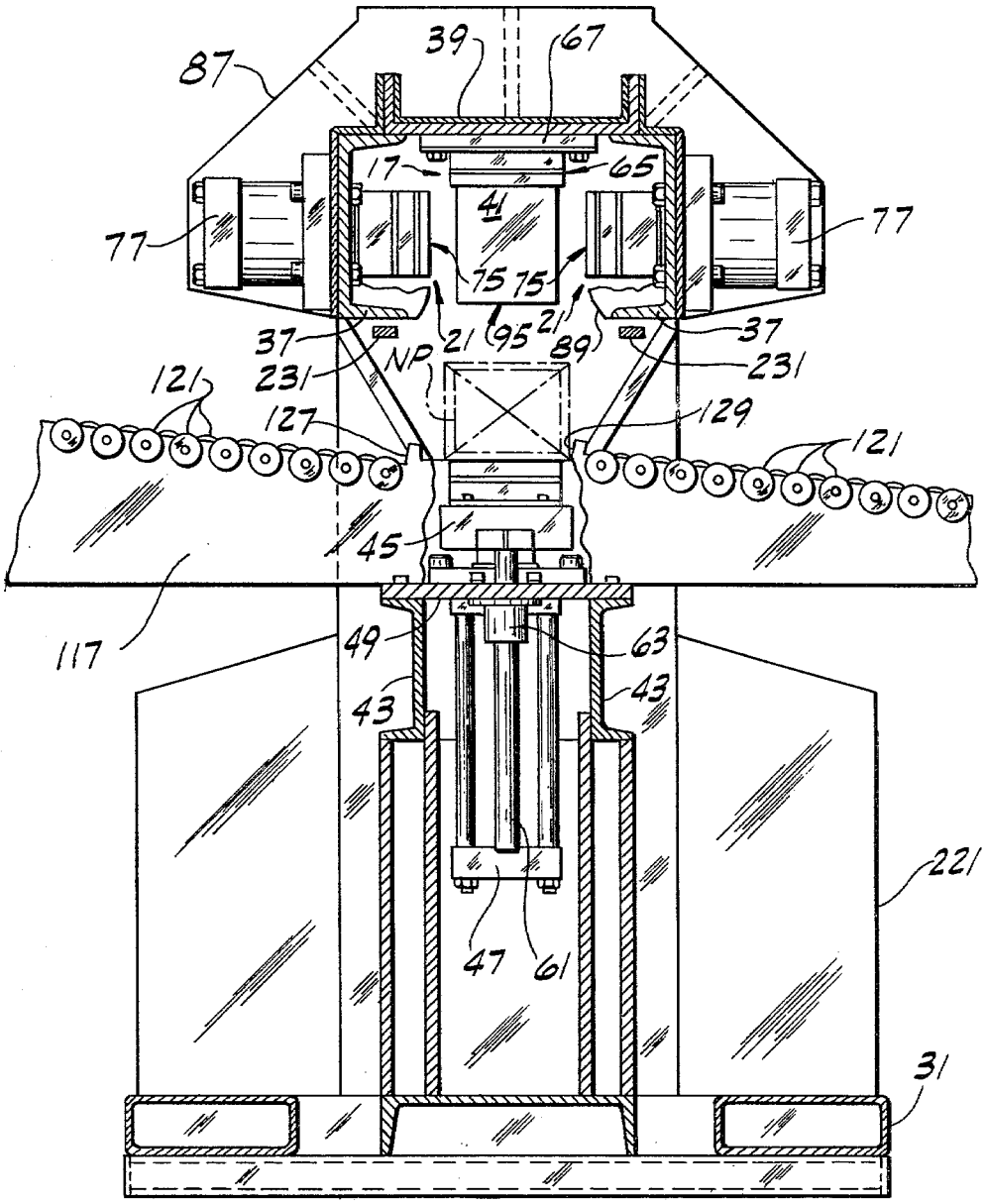
FIG. 5 is an enlarged vertical section on line 5—5 of FIG. 2, portions being broken away for purposes of illustration.
Figure 8:
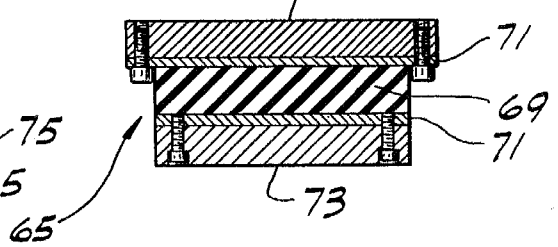
FIG. 8 is a sectional view illustrating the construction of an upper platen.

Upper platen means 17 comprises a pair of stationary platens, each generally indicated at 65, disposed in pressing chamber 41 for engagement by a tie lifted into the chamber by the lower platens 45. As illustrated in FIGS. 5 and 8, the construction of an upper platen is generally similar to that of a lower platen and includes a metal base plate 67 fastened on the underside of upwardly-opening channel 39, a resilient pad 69 sandwiched between and bonded to two metal facing plates 71, and a downwardly-facing metal platen 73.

Figure 9:
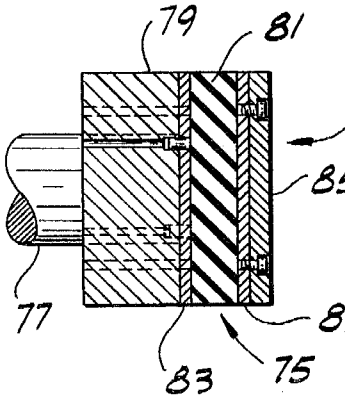
FIG. 9 is a sectional view illustrating the construction of an upper platen.

FIGS. 5 and 9 show the side platen means 21 as comprising two pairs of opposing side platens 75 mounted on opposite sides of the pressing chamber adjacent opposite ends thereof on the cylinder rods of four double-acting cylinders 77 (constituting second power means) for horizontal movement between retracted positions and extended positions in which the platens engage opposite sides of a tie within the pressing chamber. Each pair of opposing cylinders 77 is mounted on the vertical webs of inwardly-opening channel beams 37 at opposite sides of chamber 41 for movement of their respective side platens toward and away from one another along a horizontal axis. It is preferred that this axis and the vertical axis of movement of the lower platens 45 therebelow lie in the same vertical plane.

Comparing FIG. 9 to FIGS. 7 and 8, it will be observed that each side platen 75 is similar in construction to the upper and lower platens 65, 45, comprising a metal base member 79 secured in suitable fashion to a respective cylinder rod 77, a resilient rubber pad 81 interposed between and bonded to two metal facing plates 83, and a vertically disposed metal platen 85 bolted to the outer (right as viewed in FIG. 9) facing plate.

Figure 10:
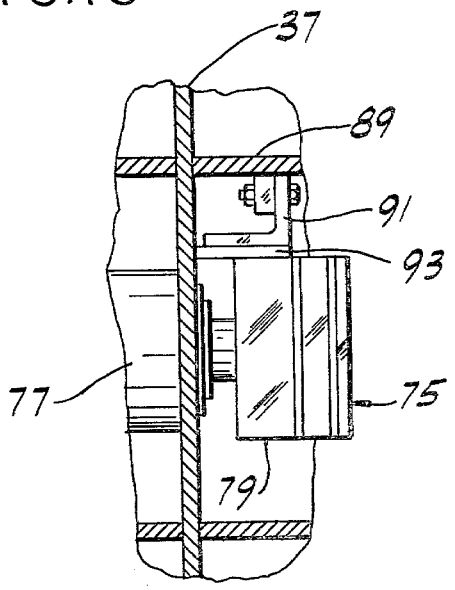
FIG. 10 is an enlarged horizontal section on line 10—10 of FIG. 6.

To provide the reinforcement necessary to withstand the large compressing forces applied to a tie by the upper, lower and side platens, a plurality (e.g., five) of downwardly-opening C-plates 87, referred to as outer C-plates, are secured (e.g., welded) to the channel beams 37, 39 on the outside of the beams at opposite sides of each pair of opposing side platen cylinders 77 and at the longitudinal center of the beams. Additional C-plates, designated 89 and referred to as inner C-plates, open downwardly within the pressing chamber 41 and are secured to the channel beams at locations corresponding to the locations of the outer C-plates 87. As shown in FIGS. 6 and 10, an angle-iron bracket 91 is secured in vertical position to a respective inner C-plate 89 adjacent each side platen 75, with one leg of the bracket extending generally parallel to one side of the metal base member 79 of the platen. An alignment plate 93 is fastened to that leg of the bracket for engagement by the base member 79 as it reciprocates back and forth thereby to maintain the side platen generally "square", that is, to keep it from rotating about the axis of cylinder 77.

The two opposing end platen assemblies of press 3, generally indicated at 95, are mounted at opposite ends of the pressing chamber on the cylinder rods of double-acting cylinders 97 (constituting third power means) for movement along a generally horizontal axis AX extending lengthwise of chamber 41 in the central vertical longitudinal plane of the press between retracted position (FIG. 4) and extended positions in which the assemblies 95 are engageable with nailing plates NP on the ends of a tie in chamber 41 for driving the plates into the tie. In this regard, it will be noted that axis AX is generally coincident with the central longitudinal axis of a tie positioned in the pressing chamber by the upper, lower and side platens 65, 45 and 75. It will also be noted that since each end platen assembly 95 is movable toward a respective end of a tie in the pressing chamber the nailing plates NP may be pressed into the tie ends without substantially moving the tie along its axis.

Figure 11:
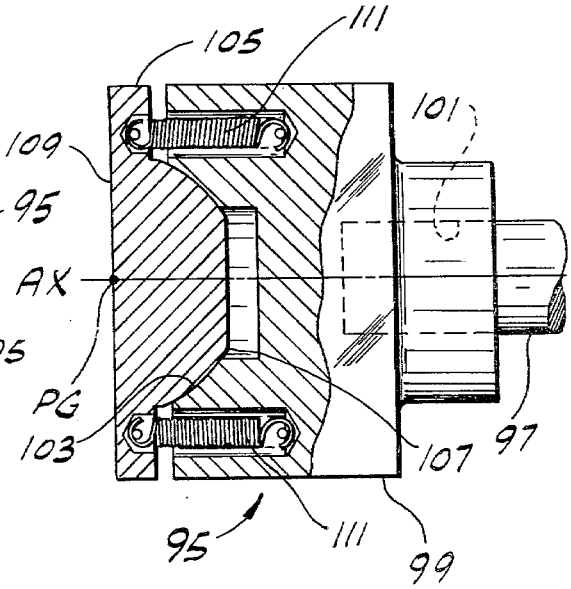
FIG. 11 is an enlarged portion of FIG. 4 showing an end platen assembly of the present invention, parts being broken away for purposes of illustration.

The end platen assemblies 95 are different in structure from the upper, lower and side platens described hereinabove and are especially adapted for conforming to ends of ties which are cut at an oblique angle, i.e., ends which are not cut "square", to ensure that the nailing plates are properly and fully embedded in the tie ends. In this regard, each end platen assembly comprises a rectangular metal base 99 having a blind bore 101 therein in which the outer end of a respective cylinder rod of cylinder 97 is secured (see FIG. 11). The outer (left) face of base 99 has a circular recess therein constituting a socket 103, the latter having a central axis generally coincident with axis AX and a peripheral wall with a predetermined radius of curvature (.e.g, $3\frac{1}{2}''$). A platen member 105 is mounted in the socket for rotational (swivel) movement with respect to the base about a point of gyration PG. As shown, the platen member has an inner rounded surface 107 with a radius of curvature substantially identical to the radius of curvature of the socket wall for providing a relatively close swivel fit between the rounded surface 107 and the socket wall, and an outer generally planar pressing surface 109 engageable with a nailing plate NP on a respective tie end for driving the plate into the tie end. Four coil springs 111 hold the base 99 and platen member 105 in assembly and bias the platen member, when swivelled out of its FIG. 11 "neutral" position, back to its neutral position in which the central axis of the platen member is generally coincident with that of socket 103. Cylinders 97 are double-acting cylinders of the flange-mounted type bolted to the sides 33 of the main frame of the press for movement of the platen assemblies toward and away from one another along horizontal axis AX. As indicated at 113 in FIG. 13, a bearing is mounted on the underside of the base member 99 of each end platen assembly for slidably receiving a guide shaft 115 extending horizontally from a respective side of the main frame. This prevents the base member of the assembly from rotating about axis AX.

It will be observed that, in accordance with this invention, swivel platen member 105 is dimensioned in such a way that its point of gyration PG lies substantially on its pressing surface 109 generally at the center thereof. Moreover, the arrangement is such that the point PG lies on axis AX. Thus, when the platen member swivels in socket 103, the center of pressing surface 109 remains fixed on axis AX. This is important for ensuring that the platen member, when swivelling to conform to an obliquely-cut tie end, does not scoot or slide the nailing plate NP on the tie end, which would tend to bend the teeth of the plate and prevent the latter from being properly pressed into the tie.

Figure 13:
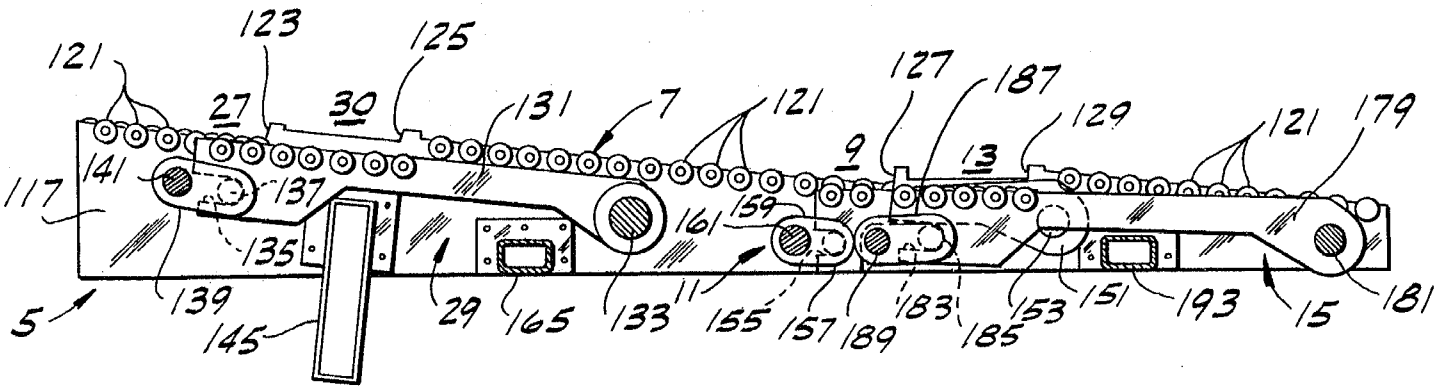
FIG. 13 is an enlarged vertical section on line 13—13 of FIG. 3 showing conveying apparatus of the present invention.

As shown in FIGS. 1, 3 and 13, conveying apparatus 5 comprises a pair of elongate generally parallel side plate 117 extending in the direction of conveyance between the lower platens 45 below pressing chamber 41. The upstream ends of these plates, which extend out from the press in cantilever fashion, are supported by braces 119 extending up from the base 31 of the press. The upper longitudinal edges of the side plates are inclined generally downwardly from left to right as viewed in FIG. 1, and a plurality of rollers 121 rotatably mounted on opposite sides of each plate project up above the upper edge of the plate for supporting ties T and enabling them to gravitate down the conveyor. Each side plate is formed with four shoulders thereon, designated 123, 125, 127 and 129, each being engageable by a tie as it is conveyed forward for stopping the tie at the dwell, centering, feed and end-plating stations 27, 30, 9 and 13, respectively. The portion of the conveyor plates 117 upstream of the end-plating station constitutes infeed conveyor means 7 and is hereinafter referred to as the infeed conveyor 7.

Three walking beam-type units mounted between the conveyor side plates constitute means 29, 11 and 15, respectively, for transferring the ties one at a time from dwell station 27 to centering station 30 and then back onto the infeed conveyor, for feeding the ties forward one at a time from the feed station to end-plating station 9, and for conveying an end-plated tie from the end-plating station out of the conveyor.

The first unit 29, referred to as a walking beam transfer unit, is operable to lift a tie at the dwell station over shoulder 123 and to transfer it in a forward direction to the centering station where it engages shoulder 125. As shown in FIGS. 3 and 13, this transfer unit 29 comprises a pair of beams 131 parallel and adjacent to the conveyor side plates 117 and connected at their front ends to a pivot shaft 133 extending between the side plates, the ends of pivot shaft 133 being journalled in the side plates downstream of the centering station 30. Beams 131 extend rearwardly from the pivot shaft to a point upstream of shoulder 123 for engaging a tie at the dwell station. The back end of each beam is slotted as indicated at 135 for receiving a pin 137 carried by two rocker arms 139 rigidly affixed, as by welding, to a rockshaft 141, the ends of which are also journalled in the conveyor side plates. The rod of a cylinder 143 secured to the vertical side wall of a housing 145 for centering means 25 has a clevis connection 147 with a lever 149 projecting radially from the rockshaft (see FIG. 2). The arrangement is such that extension of the cylinder rod rotates shaft 141 and rocker arms 139 in one direction to swing the beams 131 upwardly about pivot shaft 133, and retraction of the rod rotates shaft 141 and rocker arms 139 in the opposite direction to swing the beams downwardly. A series of rollers identical to rollers 121 are pinned to beams 131 on opposite side faces thereof and project above the upper edges of the beams for supporting a tie when the beams are raised.

Figure 14A:
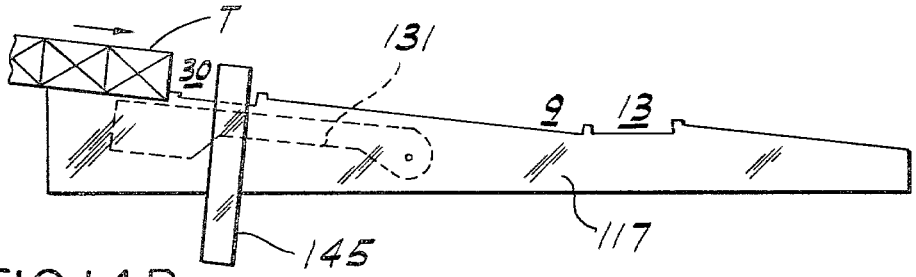
FIGS. 14A–14E are sequential diagrammatic views illustrating how a tie is conveyed through centering means of the end-plating apparatus.
Figure 14B:
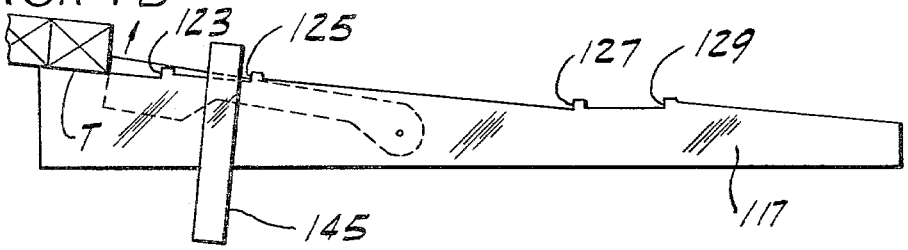
Figure 14C:
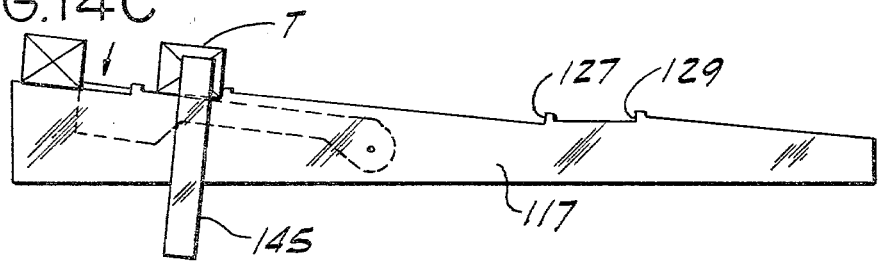
Figure 14D:
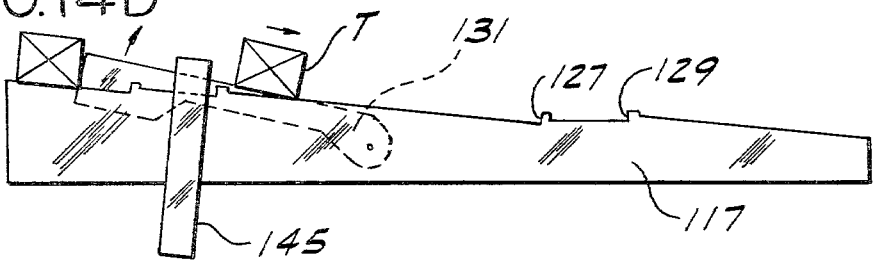

The piston rod of cylinder 143 has four different positions of extension for moving the walking beam transfer unit 29 through a cycle in which the beams 131 swing from a lowered or home position (FIG. 14A) in which the upstream ends of the beams are positioned immediately below a tie at dwell station 27 to a first intermediate raised position (FIG. 14B) in which the beams are raised sufficiently to permit a tie lifted by the beams to gravitate to the centering station; from the first intermediate position to a slightly lower second intermediate position (FIG. 14C) in which the beams are spaced below a tie resting on the conveyor side plates 117 at the centering station to permit the tie to be centered by centering means 25; from the second intermediate position to a maximum raised position (FIG. 14D) in which the arms are raised sufficiently to permit a tie lifted from the centering station to gravitate down on rollers 121 onto the infeed conveyor 7 for conveyance to feed station 9; and from the maximum raised position back down to the home position.

The second walking beam unit 11, referred to as a feeder unit, is operable to lift a tie at the feed station over shoulder 127 and to feed it forward to the end-plating station (after an end-plated tie has been conveyed from the end-plating station). This unit 11 comprises a pair of feeder beams 151 (FIGS. 3 and 13) extending in front-to-back direction immediately adjacent the conveyor side plates 117, the beams being pivotally connected at their front (right) ends as indicated at 153 to the side plates. A series of rollers identical to rollers 121 pinned to the feeder beams 151 on opposite side faces thereof project above the upper edges of the beams. The upstream ends of the beams, which are disposed for engaging a tie at the feed station 9, are slotted at 155 to receive pins 157 carried by two pairs of rocker arms 159 rigidly affixed to a second rockshaft 161 journalled in the conveyor side plates 117. The piston rod of a double-acting cylinder 163 mounted on a cross member 165 extending between the conveyor side plates upstream of rockshaft 161 has a clevis connection 167 with a lever 169 extending radially from the shaft. The arrangement is such that extension of the piston rod in cylinder 163 (constituting power means) rotates shaft 161 and rocker arms 159 in one direction to swing the feeder beams 151 of the walking beam feeder unit up about pivot connections 153 from a lowered position to a raised position in which the arms lift the tie at feed station 9. When raised, the back ends of the beams 151 are disposed above shoulder 127 and are inclined downwardly from the feed station to the end-plating station, thereby enabling the tie to gravitate to the end-plating station where it engages shoulder 129. Retraction of the cylinder rod rotates rockshaft 161 and rocker arms 159 thereon in the opposite direction to move the feeder beams back down to their lowered position.

Nailing plate detectors 171 (see FIGS. 3 and 4) are mounted on opposite side of the infeed conveyor adjacent the feed station 9 for detecting the presence of nailing plates NP on the ends of ties being fed to the end-plating station. In this regard, nailing plates are preferably lightly applied (e.g., tacked on) to the ends of the ties after they have been centered and transferred from the centering station back onto the infeed conveyor. Each detector 171 has a pair of sensing wires W1, W2 extending therefrom which are disposed for brushing against the end of a tie as it is lifted by the feed unit 11 to detect whether a nailing plate has been applied to the tie end. Each detector is mounted at the outer end of a support bar 173 which has pin-and-slot connections 175 with a bracket 177 secured to the main frame of the press, the detectors thus being adjustable toward and away from one another to accommodate ties of different length.

The third walking beam unit 15, referred to as a discharge unit, is similar to the two walking beam units 29, 11 previously described and is operable to discharge a tie from the press after it has been end-plated. This unit comprises a pair of beams 179 extending generally parallel to the conveyor side plates 117 inwardly of feeder beams 151. The front ends of beams 179 are connected to a pivot shaft 181 having its ends journalled in the conveyor side plates downstream of the end-plating station. The upstream ends of the beams 179 are disposed below the end-plating station for engagement with a tie at that location. A series of rollers identical to rollers 121 described above are pinned to the beams on opposite side faces thereof project up above the upper edges of the beams. As indicated at 183, the upstream ends of the beams 179 are slotted for receving pins 185 carried between two pairs of rocker arms 187 secured to a third rockshaft 189, the ends of which are journalled in the conveyor side plates 117 immediately downstream of rockshaft 161 of the feeder unit. The rod of a double-acting cylinder 191 (constituting power means) mounted on a cross member 193 extending between the conveyor side plates downstream of shaft 189 has a clevis connection 195 with a lever 197 projecting radially from the shaft. The arrangement is such that extension of the rod in cylinder 191 rotates shaft 189 and rocker arm 187 in one direction to swing beams 179 of the walking beam discharge unit about pivot shaft 181 from a lowered position to a raised position in which the arms are disposed above shoulder 129 and are inclined downwardly for receiving an end-plated tie as it is lowered by the lower platens 45 for discharging a tie from the press. Retraction of the rod in cylinder 191 rotates rockshaft 189 and rocker arms 187 in the opposite direction to swing the beams 179 back down to their lowered position.

It will be observed that the upstream end of the discharge unit, when in its raised position, is designed for engagement by a tie being fed forwardly by the feeder unit 11 to block the tie from moving to the end-plating station prior to discharge of an end-plated tie from the press. As will appear, the discharge unit cylinder 191 is operable subsequent to the discharge of an end-plated tie from the press to swing the unit from its raised to its lowered position in which the upstream ends of beams 179 are disposed below and out of engagement with a tie on the raised feeder unit 11, thereby permitting the tie to gravitate down to the end-plating station.

Figure 16:
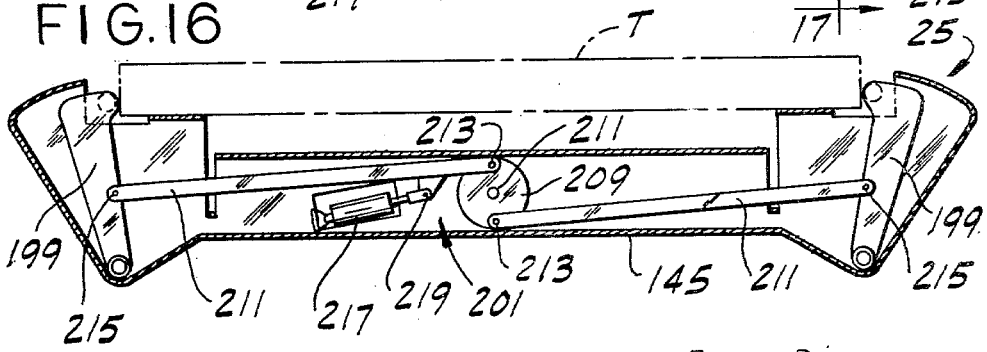
FIG. 16 is a view similar to FIG. 15 showing the centering means in its closed position centering a tie.
Figure 17:
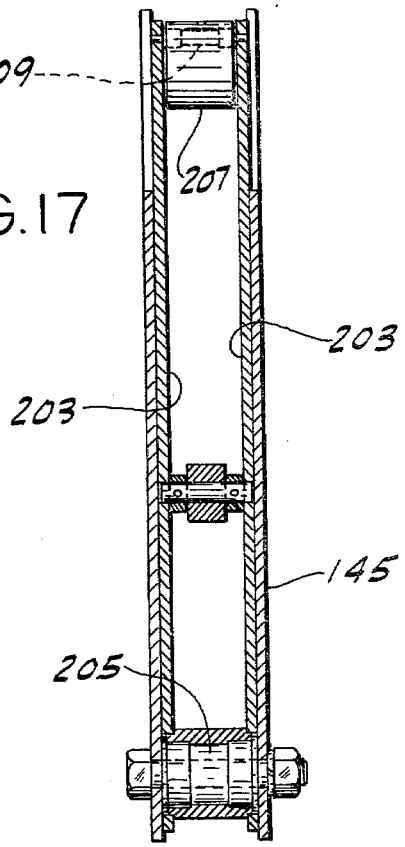
FIG. 17 is an enlarged vertical section on line 17—17 of FIG. 15.

FIGS. 16 and 17 illustrate centering means 25 as comprising a pair of vertical levers 199 mounted on opposite sides of the infeed conveyor 7 for pivotal movement about generally horizontal axes which extend generally parallel to the longitudinal centerline of the conveyor and which are spaced substantially equidistantly from the centerline on opposite sides thereof, and means indicated generally at 201 for simultaneously pivoting the levers 199 between a first or open position (FIG. 16) in which they are clear of the ends of a tie at the centering station 30 and a second or closed position (FIG. 17) in which they are engageable with the ends of the tie for centering it in side-to-side direction with respect to the infeed conveyor (i.e., conveyor side plates 117).

Figure 15:
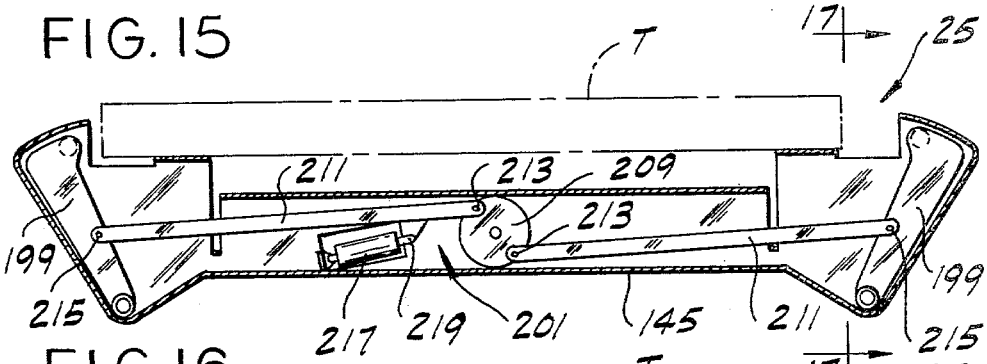
FIG. 15 is a vertical section on line 15—15 of FIG. 3 showing the centering means in its open position.

As shown in FIG. 17, each lever comprises a pair of parallel side plates 203 pivotally mounted at their lower ends on a horizontal pivot pin 205 extending between opposite side walls of the housing 145 for the centering mechanism. A roller 207 is eccentrically mounted on a pin 209 between the upper ends of the side plates for engagement with a respective end of a tie at the centering station. Means 201 for pivoting the levers 199 between open and closed positions comprises a rotary member or wheel 209 mounted within housing 145 on a shaft 211 for rotation about a generally horizontal axis corresponding to the longitudinal centerline of the infeed conveyor 7, and a pair of links each designated 211 interconnecting wheel 209 and levers 199. Each link is pin-connected at one end to the wheel, as indicated at 213, and at its other end to a respective lever 199, as indicated at 215. The pin connections between the links and the wheel are on diametrically opposite sides of shaft 211, the arrangement being such that on rotation of the wheel in one direction (clockwise as viewed in FIGS. 15 and 16) the levers move toward their closed position and on rotation in the opposite direction (counterclockwise), the levers move toward their open position. Movement of the levers between their open and closed positions is effected by a cylinder 217 pivotally mounted within housing 145. The extensible and retractible rod of the cylinder is pin-connected at 219 to one of the links in the manner shown so that in and out movement of the rod reciprocates the link generally along its own axis for rotating the wheel and thereby imparting motion to the other link in the opposite direction. Since the wheel 209 and both links 211 move conjointly, it will be understood that the wheel or either link may be the driven member.

The various cylinders of the end-plating apparatus of the present invention are powered by an electrically driven hydraulic pressure unit, comprising an electric motor M, a low-pressure high-volume hydraulic pump P1, a high-pressure low-volume hydraulic pump P2, and a hydraulic fluid reservoir R, all mounted on the base 3 of the press below channels 43 extending between the sides of the press frame. A housing 221 having removable louvered panels 223 encloses this machinery to protect it from the elements when used outdoors. Similarly, the top of the main frame is protected by a sheet metal hood 225 having removable panels 227 for providing access to the side platen cylinders 77. The outwardly projecting portions of the end platen cylinders 97 are protected by removable caps 229, which may also be of sheet metal.

The electrical circuitry of the end-plating apparatus is diagrammed in detail in FIGS. 18–22 wherein reference characters L1 and L2 designate main power lines connected to a suitable power source (not shown). As will be observed from these drawings, the operation of apparatus 1 is controlled by a plurality of manually operable (e.g., pushbutton) switches PB-1–PB-4, normally-open single-throw limit switches LS-1–LS-29, normally-open pressure-actuated switches PS-1–PS-3, relays R-1–R-54 and solenoids S-1–S-9. Solenoids S1–S7 control solenoid valves SV-1–SV-7 which operate the twelve cylinders of the end-plating apparatus to power the various components of the apparatus in the manner described hereinbelow.

Figure 23:
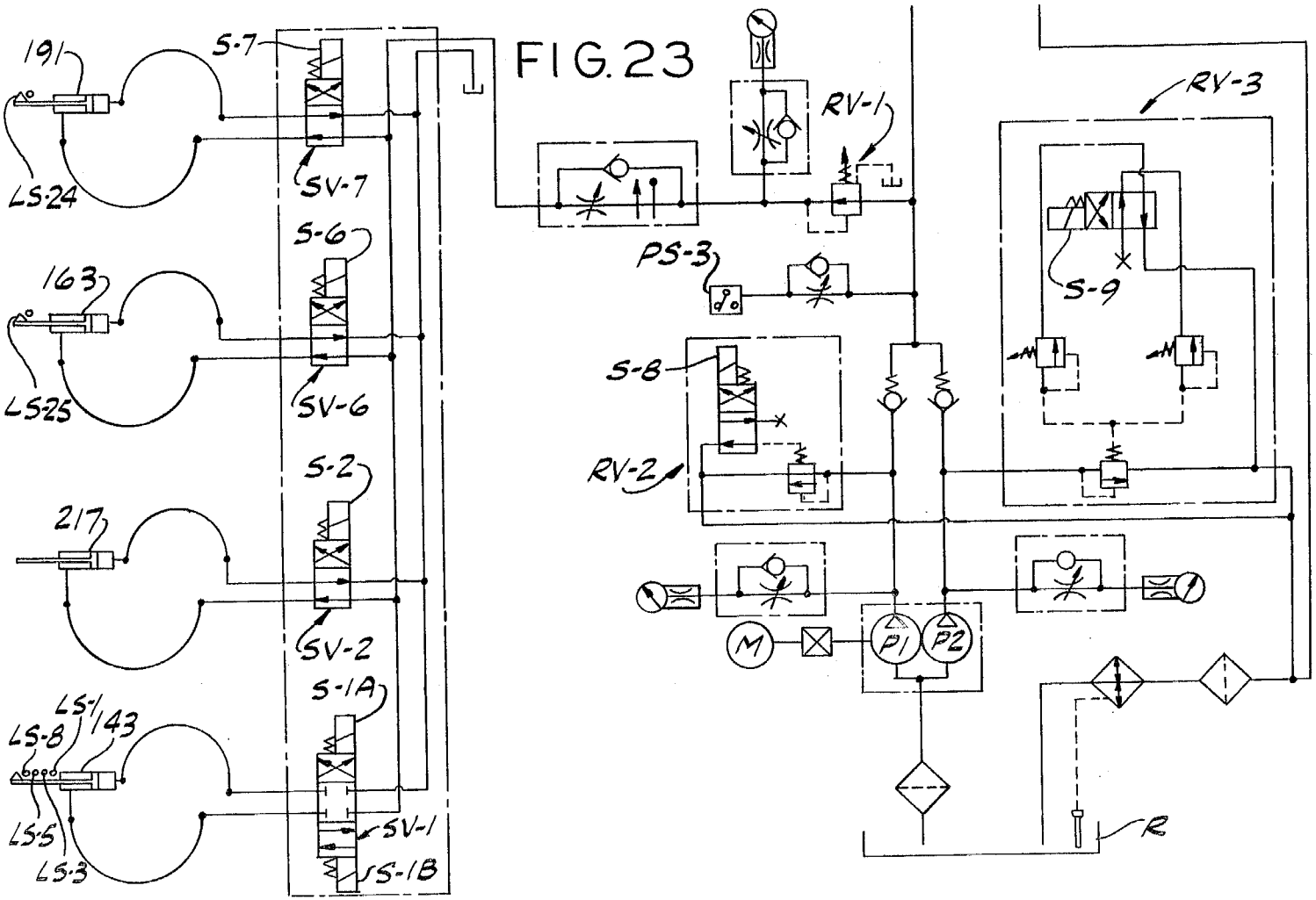
FIGS. 23 and 24 are diagrams of the hydraulic circuitry of the present invention.
Figure 24:
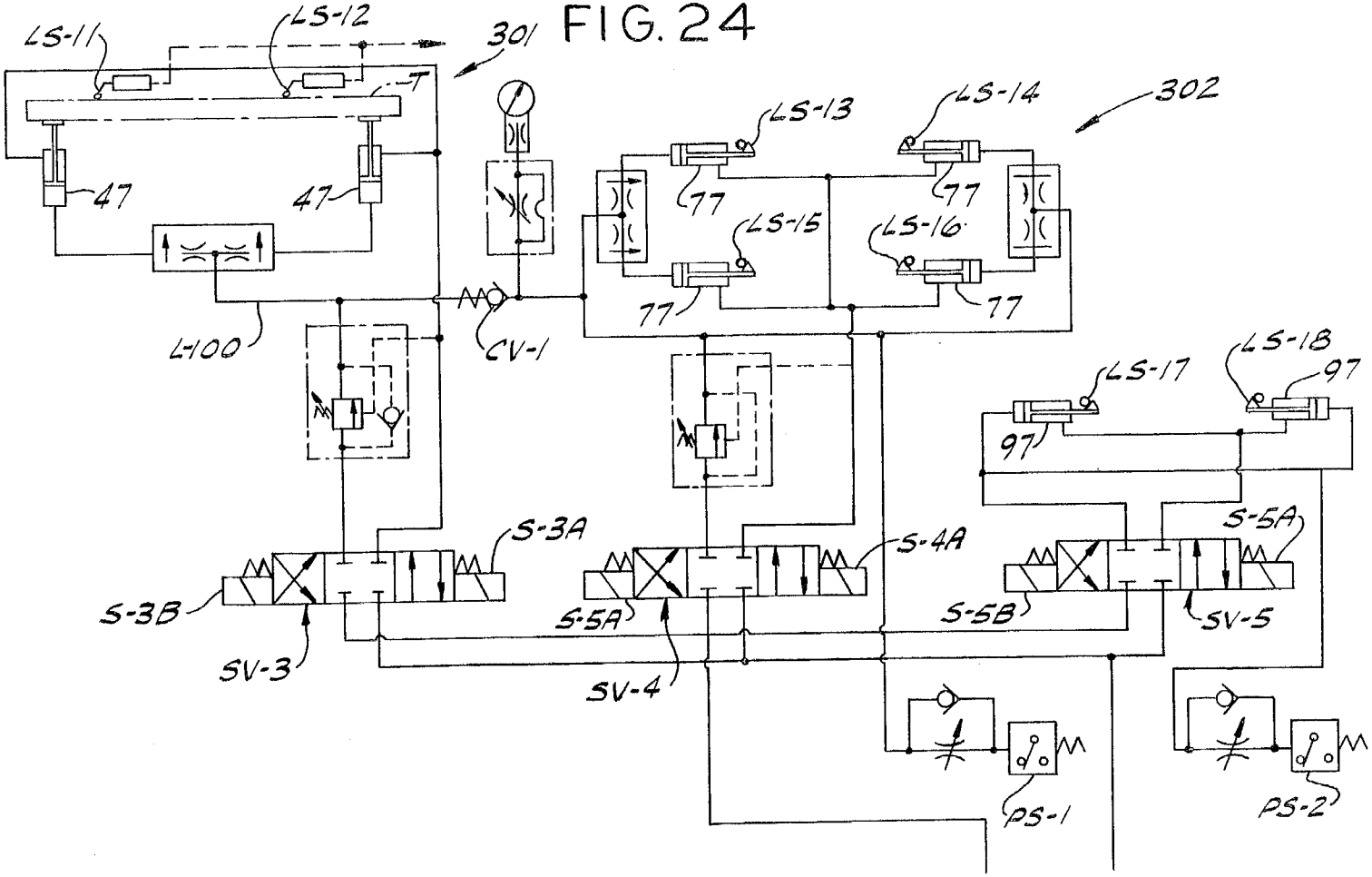

The hydraulic circuitry of end-plating apparatus 1 is shown in FIGS. 23 and 24.

Figure 21:
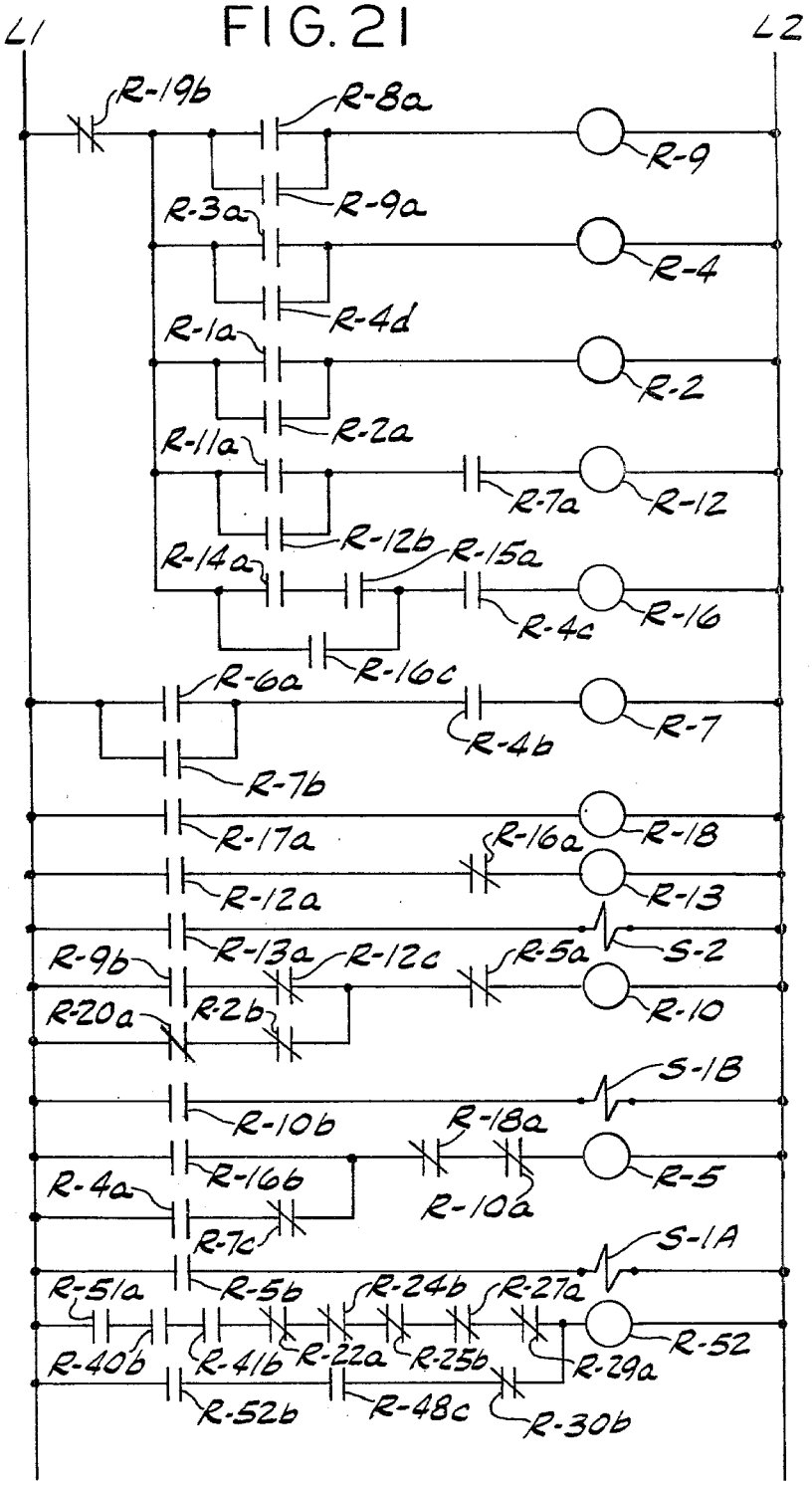

Operation of the end-plating apparatus is as follows:

Power to the motor M and other components of the electrical circuitry is controlled by manually operable (e.g., pushbutton) start and stop switches designated PB-1 and PB-2, respectively, the start switch being normally open and the stop switch normally closed. With the power on and the walking beam transfer unit in its lowered or "home" position, limit switch LS-1 on cylinder 143 is actuated, energizing relay R-1 to close contacts R1*a* (FIG. 21). The closure of these contacts energizes relays R-2 which closes normally-open contacts R-2*a*, establishing a holding circuit for the relay R-2, and opens normally-closed contacts R-2*b*. When a tie T arrives at dwell station 27 (FIG. 14A) it trips limit switch LS-2 (FIG. 18) which energizes relay R-3 to close normally open relay contacts R-3*a* (FIG. 21). This in turn energizes relay R-4 to close five sets of contacts R-4*a*–R-4*d*, the latter closed contacts R-4*d* establishing a holding circuit for relay R-4. Closure of relay contacts R-4*a* energizes relay R-5 (FIG. 21), which opens normally-closed contacts R-5*a* and closes normally-open relay contacts R-5*b* to energize solenoid S-1A of solenoid valve SV-1 to operate cylinder 143 to swing the walking beam transfer unit upwardly from its "home" position (FIG. 14A) to its first intermediate position (FIG. 14B) in which a tie at dwell station 27 is lifted and permitted to gravitate over shoulder 123 to the centering station 30 where it engages shoulder 125. Movement of the transfer unit to its FIG. 9B position trips a limit switch LS-3 on cylinder 143 to energize relay R-6 and close normally-open relay contacts R-6*a* (FIG. 21). With contacts R-6*a* and R-4*b* closed, relay R-7 is energized to close contacts R-7*a* and R-7*b*, the latter establishing a holding circuit for relay R-7. The energization of relay R-7 also serves to open normally-closed contacts R-7*c*, which deenergizes relays R-5 and solenoid S-1 of solenoid valve SV-1 to stop further upward movement of the transfer unit.

On arrival of a tie T at the centering station 30, limit switch LS-4 (FIG. 18) is tripped to energize relay R-8, closing normally-open relay contacts R-8*a* (FIG. 21) and thereby energizing relay R-9 to close contacts R-9*a* and R-9*b*. The closure of normally-open contacts R-9*a* establishes a holding circuit for relay R-9, while the closure of normally-open contacts R-9*b* energizes a relay R-10. Energization of this relay opens normally-closed relay contacts R-10*a* and closes normally-open relay contacts R-10*b* to energize the solenoid S1B of solenoid valve SV-1 to operate cylinder 143 to move the transfer unit down to its second intermediate position (FIG. 14C) in which beams 131 are disposed below and out of engagement with the tie at the centering station. When resting in this position on the conveyor side plates 117, the tie is ready to be centered transversely with respect to the infeed conveyor.

Limit switch LS-5 on cylinder 143 is tripped when the transfer unit reaches its second intermediate position. This energizes relay R-11 to close normally-open relay contacts R-11*a*. With contacts R-11*a* and R-7*a* (FIG. 21) closed, relay R-12 is activated to close normally-open relay contacts R-12*a* and R-12*b*, the latter of which establishes a holding circuit for the relay. The energization of relay R-12 also serves to open normally-closed relay contacts R-12*c* which deenergizes relay R-10 and solenoid S-1B of solenoid valve SV-1 to stop further downward movement of the transfer unit. The closure of contacts R-12*a* energizes relay R-13 to close contacts R-13*a* to energize solenoid S-2 of solenoid valve SV-2 to operate cylinder 217 to move the centering levers 199 at opposite sides of the infeed conveyor from their open (FIG. 15) to their closed (FIG. 16) position for centering tie T transversely with respect to the conveyor. When the eccentrically mounted rollers 207 on the centering levers 199 engage the tie ends, they swing on pins 209 to trip limit switches LS-6 and LS-7 mounted in housing 145 behind the rollers.

When the T reaches its centered position, both LS-6 and LS-7 are closed to energize relays R-14 and R-15, respectively. This closes normally-open relay contacts R-14*a* and R-15*a* (FIG. 21) which, since relay contacts R-4*c* are also closed, energizes relay R-16 to open normally-closed contacts R-16*a* to deenergize relay R-13 and solenoid S-2 of solenoid valve SV-2 for retracting the rod of cylinder 217 to open the centering levers 199. Energization of relay R-16 also closes contacts R-16*b* and R-16*c*, the latter of which establish a holding circuit for relay R-16. The closure of contacts R-16*b* again energizes relay R-5 to close normally-open contacts R-5*b* to energize solenoid S-1A of valve SV-1 to operate cylinder 143 to move the transfer unit from its FIG. 14C to its FIG. 14D (maximum raised) position. This enables the centered tie to gravitate on rollers 121 down the inclined beams 131 onto the infeed conveyor 7 for conveyance to feed station 9. When the transfer unit reaches its FIG. 14D position, limit switch LS-8 on cylinder 143 is tripped, energizing relay R-17 which closes relay contacts R-17*a*. The closure of these contacts R-17*a* energizes relay R-18 to open normally-closed contacts R-18*a* to deenergize relay R-5 and solenoid S-1A of valve SV-1 to stop further upward movement of the unit.

As the centered tie T moves down the infeed conveyor toward the feed station, it trips a limit switch LS-9 (FIG. 18) disposed immediately downstream of the centering station. This energizes a relay R-19 to close normally-open contacts R-19*a* (FIG. 20) and open normally-closed contacts R-19*b* (FIG. 21). The closure of contacts R-19*a* energizes relay R-20 which opens normally-closed contacts R-20*a* (FIG. 21) to deenergize relay R-10 and solenoid S-1B of valve SV-1. So long as this valve remains deenergized, the transfer unit will remain in its maximum raised (FIG. 14D) position. The opening of contacts R-19*b* deenergizes relays R-9, R-4, R-2, R-12, R-16, R-7, R-13, R-10 and R-5.

Figure 14E:
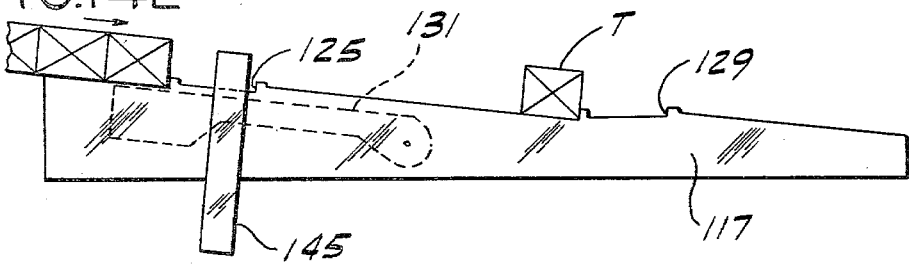

As the tie T gravitates down the infeed conveyor past limit switch LS-9, the latter will open, deenergizing relay 19, closing normally-open contacts R-19*a* and opening normally-closed contacts R-19*b*. When contacts R-19*a* open, relay R-20 is deenergized which closes normally-closed contacts R-20*a*. This in turn energizes relay R-10 which closes normally-open relay contacts R-10*b* to energize solenoid S-1B of valve SV-1 to operate cylinder 143 to move the transfer unit down to its home position (FIG. 14E). On reaching this position, limit switch LS-1 is again closed, with the entire cycle repeating when the next tie arrives at the dwell station and trips limit switch LS-2.

It will be noted that the spacing between the centering and feed stations 30, 9 on the infeed conveyor is sufficient to hold a plurality of ties (e.g., five). When the ties are in this location, waiting to be fed into the press 3, nailing plates NP are applied to the tie ends as described above. If the ties back up on the infeed conveyor from the feed station to a point where there is no room for more ties, the trailing tie in the group will hold limit switch LS-9 closed, thereby maintaining the transfer unit in its maximum raised position until the trailing tie moves off the switch and allows it to open to initiate another cycle of the transfer unit.

Figure 22:
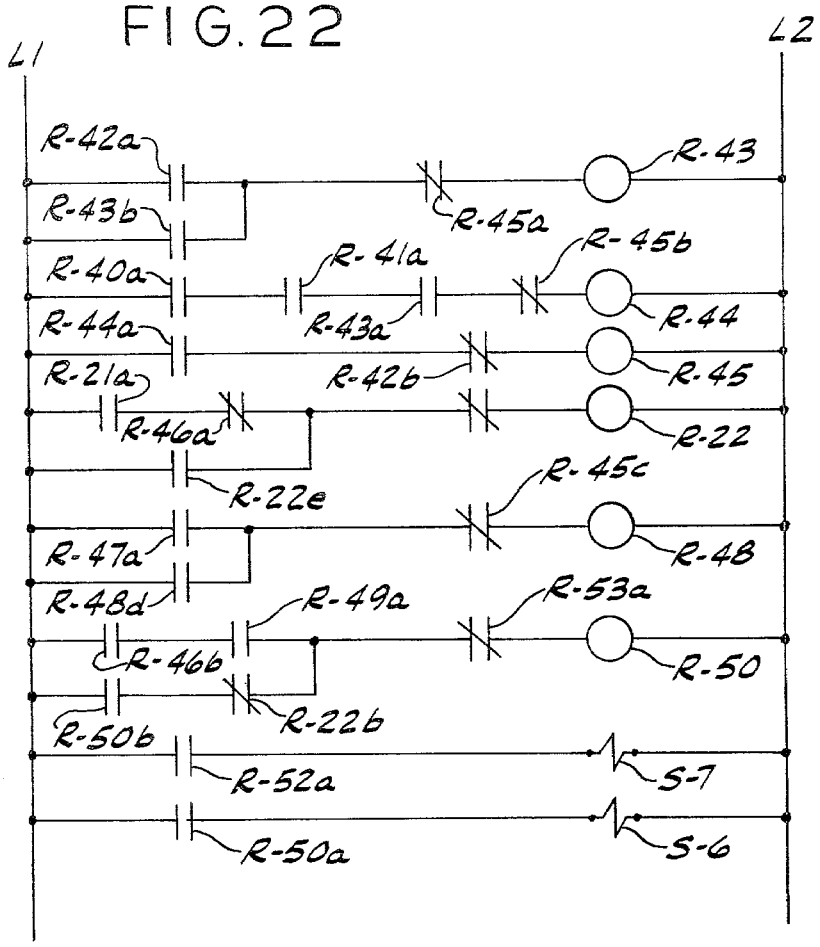
Figure 25A:
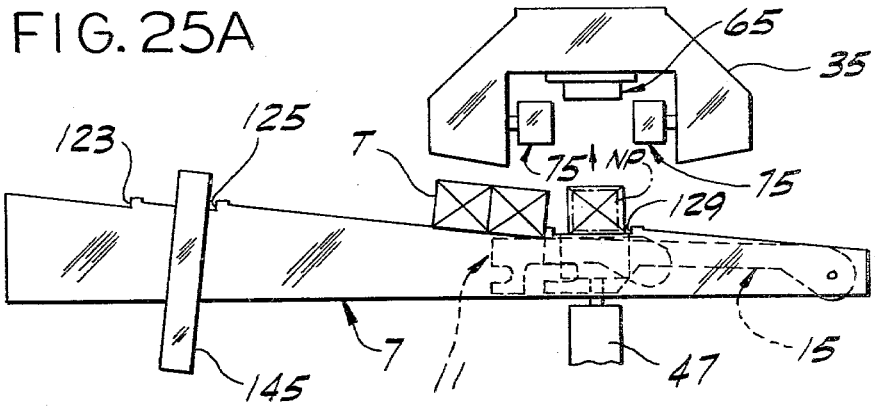
FIGS. 25A–25E are sequential diagrammatic views of a pressing cycle of the apparatus of the present invention.
Figure 25B:
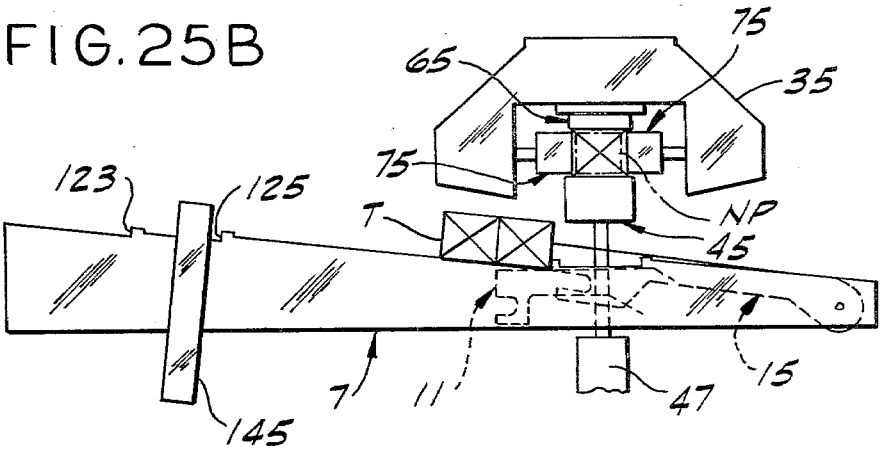
Figure 25C:
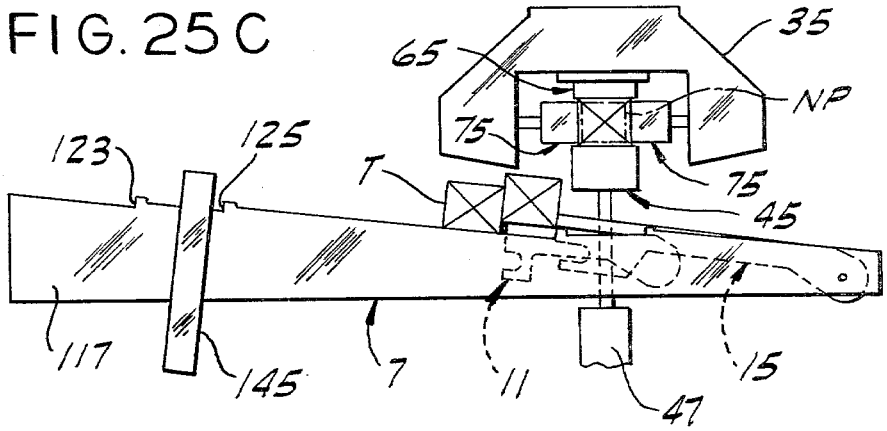
Figure 25D:
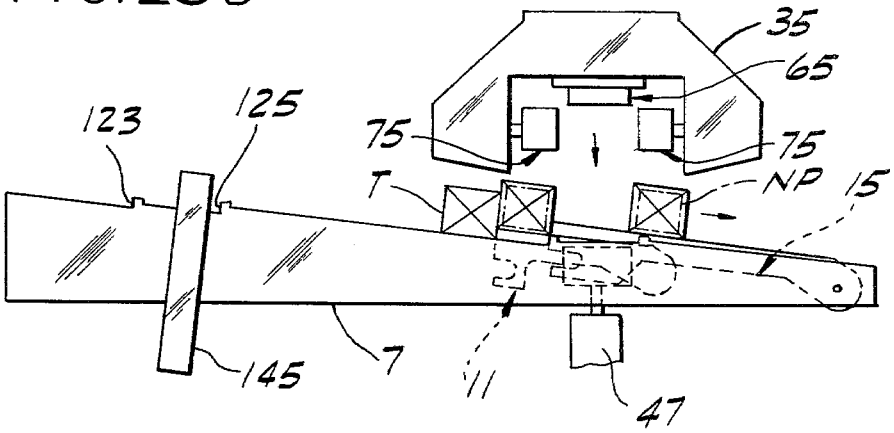
Figure 25E:
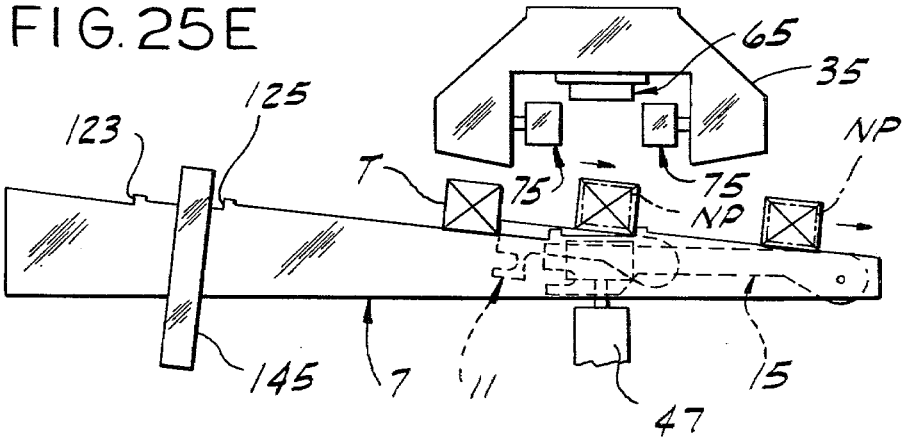

A pressing cycle during which nailing plates NP on the ends of a tie are pressed into the tie ends as shown schematically in FIGS. 25A–25E) will now be described, starting with a tie at the end-plating station 13 in the press and with the feed and discharge units 11 and 15 in their lowered positions (see FIG. 25A). On arrival at the end-plating station, tie T trips a limit switch LS-10 which energizes relay R-21 (FIG. 18) to close relay contacts R-21*a* (FIG. 22). This energizes relay R-22 to open normally closed relay contacts R-22*a* (FIG. 21) and R-22*b* (FIG. 22), and to close normally-open relay contacts R-22*c*–R-22*e*, the latter contacts R-22*e* being in a holding circuit for relay R-22. The closure of contacts R-22*d* (FIG. 19) results in the energization of relay R-23. This closes normally-open contacts R-23*a* which energizes solenoid S-3A of solenoid valve SV-3 to operate cylinders 47 to move the lower platens 45 through an upstroke in which the platens raise a tie at end-plating station 13 toward the stationary upper platens 65 in the pressing chamber 41.

Figure 20:
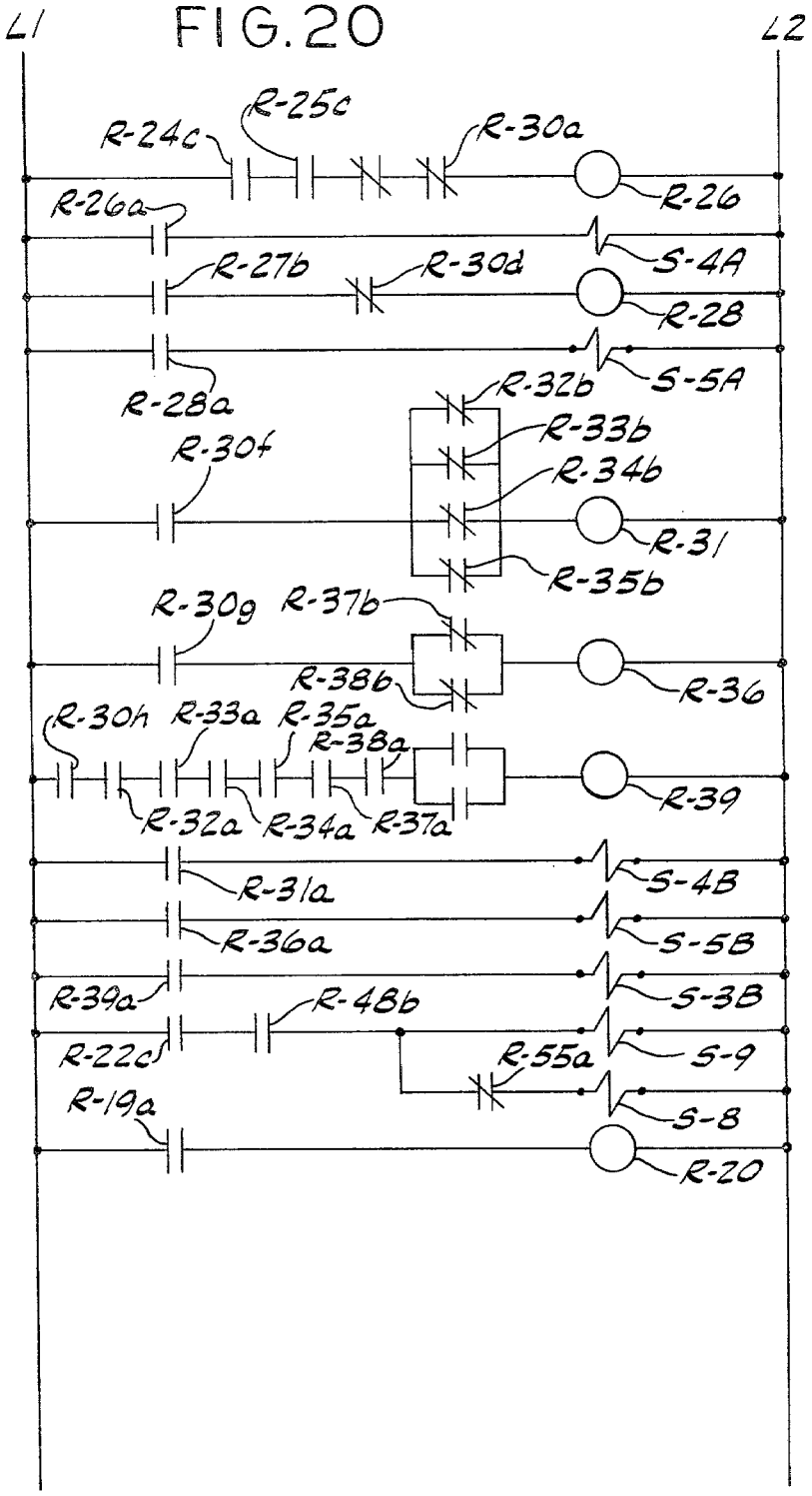

Limit switches LS-11 and LS-12 are mounted adjacent the upper platens 65 for actuation by a tie as it is lifted into the pressing chamber. When tripped, these switches function to energize relays R-24 and R-25 to open the normally-closed contacts R-24*a* and R-25*a* to deenergize relay R-23 and solenoid SV-3A of valve SV-3 to stop further upward movement of the lower platens 45 when the top of the tie is closely adjacent but preferably not in contact with the upper platens 65 (i.e., prior to application of compressing forces to the top and bottom faces of the tie). Energization of relays R-24 and R-25 also functions to open normally closed contacts R-24*b* and R-25*b* (FIG. 21) and to close normally-open relay contacts R-24*c* and R-25*c* (FIG. 20). The closure of these latter contacts energizes relay R-26. This in turn closes relay contacts R-26*a* to energize solenoid S-4A of solenoid valve SV-4 to operate cylinders 77 to move the four side platens 75 to their extended positions in which they engage opposite side faces of tie T in the pressing chamber. If the tie is off-center in front-to-back direction with respect to the press, the movement of opposing side platens toward one another will serve to center the tie in the central longitudinal plane of the press on axis AX. As will be described, the hydraulic circuitry between the lower and side platen cylinders 47, 77 is such that when the side platens begin exerting a compressing force on the sides of the tie, cylinders 47 will also operate to move the lower platens 45 up to press the tie against the upper platens, the lower and side platen cylinders thus being operable in unison to apply, via the upper, lower and side platens, substantially simultaneous and equal compressing forces to the top, bottom and side faces of the tie. This is important to ensure that the tie remains "square" as it is compressed. In this regard, some ties may be split in the diagonal (corner-to-corner) direction. If such a tie were not compressed on all sides with substantially simultaneous and equal compressing forces, the portions of the tie on opposite sides of the split might shift relative to one another, making the tie unacceptable for use. The operation of the end-plating apparatus of the present invention eliminates this risk.

Referring to FIG. 24, the hydraulic circuitry of the lower platen cylinders 47 is generally designated 301 and the hydraulic circuitry of the side platen cylinders is generally designated 302. These circuits 301, 302 are connected by a line L-100 having a spring-biased check valve CV-1 therein permitting flow of hydraulic fluid from the cylinder ends of the side platen cylinder 77 to the cylinder ends of the lower platen cylinder 47, but preventing flow in the opposite direction. Thus, when the pressure exerted by the side platens 75 on a tie in the pressing chamber is great enough to open check valve CV-1 against the bias of its spring, hydraulic fluid flows to the cylinder ends of the lower platen cylinders 47 to raise the lower platens to press the tie thereon against the upper platens 65. In this manner the forces exerted by the lower and side platens 47, 77 are substantially simultaneous and equal. The fluid displaced from the rod ends of cylinders 47 as the lower platens move upwardly is sufficiently small to enable it to leak past solenoid valve SV-3 and thence back to reservoir R.

When the pressure exerted by the side platens 75 reaches a predetermined pressure (e.g., 1300 psi) a pressure switch PS-1 is actuated (FIG. 18), energizing relay R-27 to open normally-closed contacts R-27*a* (FIG. 21) and to close normally-open contacts R-27*b* (FIG. 20). The closure of the latter set of contacts energizes relay R-28 to close contacts R-28*a* which, in turn, energizes solenoid S-5A of solenoid valve SV-5 to operate cylinders 97 to move the swivel end-platen assemblies 95 inwardly along axis AX toward their extended positions in which they engage the nailing plates NP on opposite ends of the tie and press the plates into the tie ends. This of course occurs while the top, bottom and side platens are compressing the tie to close any cracks therein. As explained above, if the ends of of the tie are cut at an oblique angle, the platen member 105 of each end-platen assembly will swivel in socket 103 against the bias of springs 111 until its outer pressing surface 109 is generally parallel to the end face of the tie and the nailing plate tacked thereon. Moreover, due to the unique construction of each assembly, when platen member 105 swivels in its socket, the center of its outer pressing surface, corresponding to the point of gyration PG of the platen member, remains fixed on axis AX, which corresponds to the axis of the tie in the pressing chamber. This assures that the platen member does not pivot or slide the nailing plate along the face of the tie as it swivels.

Figure 19:
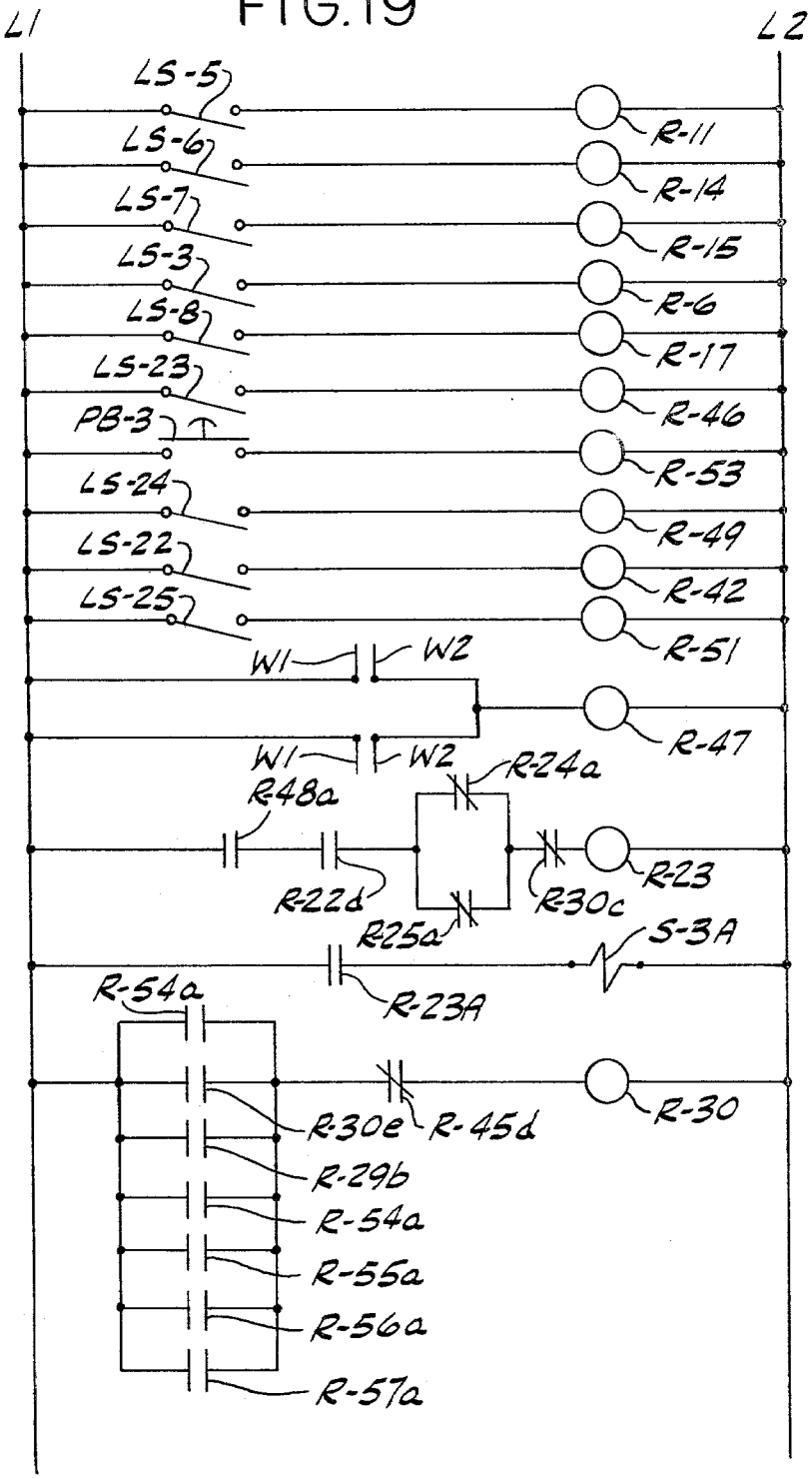

When the pressure exerted by the end platen assemblies reaches a predetermined pressure (e.g., 1600 psi) sufficient to ensure that the nailing plates are fully embedded in the tie ends, pressure switch PS-2 is actuated to energize relay R-29, which opens normally-closed contacts R-29*a* (FIG. 21) and closes normally-open contacts R-29*b* (FIG. 19). The closure of contacts R-29*b* energizes relay R-30 to initiate movement of the lower, side and end platens to their retracted positions. More particularly, energization of relay R-30 opens four sets of normally-closed contacts R-30*a*–R30*d* and closes four sets of normally-open relay contacts R-30*e*–R-30*h*. Opening contacts R-30*a* (FIG. 20) deenergizes relay R-26 and solenoid valve SV-5. Closing contacts R-30*f* energizes relay R-31 to close normally-open relay contacts R-31*a* to energize solenoid S-4B of valve S-4 to operate cylinders 77 to retract the side platens 75.

Four limit switches LS-13–LS-16 (FIG. 18) on the four side cylinders 77 are tripped when the side platens reach their retracted position. This in turn energizes relays R-32–R-35 (FIG. 20) for closing normally-open contacts R-32*a*–R-35*a* in the circuit controlling lower platen solenoid valve, and for opening normally-closed contacts R-32*b*–R-35*b* which deenergizes relay R-31 and solenoid S-4B of valve SV-4 for halting the retraction of the cylinder rods in side platen cylinders 77.

The energization of relay R-30 (FIG. 19) when the pressure exerted by the end platen assemblies 95 reaches 1600 psi also closes normally open contacts R-30*g* which energizes relay R-36 (FIG. 20). This in turn closes normally-open contacts R-36*a* to energize solenoid solenoid S-5B of valve SV-5 to retract the end platen assemblies. On reaching their retracted position, these assemblies trip limit switches LS-17 and LS-18, thereby energizing relays R-37 and R-38 (FIG. 18), respectively, to close normally-open relay contacts R-37*a* and R-38*a* and to open normally-closed relay contacts R-37*b* and R-38*b*, the latter serving to deenergize relay R-36 and solenoid S-5B of valve SV-5 to stop further retraction of the end platens. With contacts R-32*a*–R-35*a*, R-37*a* and R-38*a* all closed, relay R-39 is energized to close normally-open contacts R-39*a* (FIG. 20) and to actuate solenoid S-3B of valve SV-3, which controls the lower platen cylinders 47, causing the lower platens 45 with the end-plated tie thereon to descend through a downstroke. In moving downwardly, these platens 45 lower the tie onto the walking beam discharge unit which is normally in its raised position (FIG. 25D), thereby permitting the tie to gravitate on rollers 121 down the unit out of the press. The lower platens continue their descent and, on arrival at their lowered position, trip limit switches LS-20 and LS-21 to energize relays R-40 and R-41. This closes normally open contacts R-40*a* and R-41*a* (FIG. 21).

After being discharged from the press, the end-plated tie trips a limit switch LS-22, thereby energizing a relay R-42 to close normally-open contacts R-42*a* and to open normally-closed contacts R-42*b* (FIG. 22). The closure of contacts R-42*a* energizes relay R-43 to close normally open contacts R-43*a* and R-43*b*, the latter of which establishes a holding circuit for relay R-43. With contacts R-40*a* and R-41*a* having been previously closed by the arrival of the lower platens 45 to their retracted (lowered) positions, the closure of contacts R-43*a* energizes relay R-44 which, in turn, closes normally-open contacts R-44*a*. Assuming that the tie has passed over and beyond limit switch LS-22, allowing it to open, normally-closed relay contacts R-42*b* will then close, energizing relay R-45 which opens normally-closed contacts R-45*a*–*d*.

Meanwhile, the arrival of a tie at the feed station 13 immediately upstream of the press trips a limit switch LS-23 which energizes a relay R-46 to open normally-closed contacts R-46*a* and to close normally-open contacts R-46*b*.

When the discharge unit is in its normally raised position, it actuates a limit switch LS-24 to energize a relay R-49, thereby closing normally open contacts R-49*a* (FIG. 22). With these contacts closed, and with contacts R-46*b* also closed (indicating the presence of a tie at the feed station), relay R-50 is energized to close contacts R-50*a* to energize solenoid S-6 of solenoid valve SV-6 to operate cylinder 163 to move the feed unit 11 from its lowered to its raised position, thereby lifting the tie at the feed station and enabling it to gravitate forwardly into engagement with the back end of the discharge unit 15, which is in its normally-up position. Energization of relay R-50 also closes normally-open contacts R-50*b* for establishing a holding circuit. On reaching its raised position, feed unit 11 trips limit switch LS-25 which energizes relay R-51 to close normally-open contacts R-51*a*.

As a tie at the feed station is raised by the feed unit, the wires W1, W2 of the detectors 171 at opposite sides of the infeed conveyor brush up against the tie ends to detect the presence of nailing plates on the tie ends. If a nailing plate is present on either end of the tie, relay R-47 is energized to close normally-open contacts R-47*a*. This energizes relay R-48 (assuming a tie is still in the press so that contacts R-45*c* are closed) to close four sets of normally-open contacts R-48*a–d*, the latter of which establishes a holding circuit for relay R-48.

The discharge unit 15 remains in its normally-up position until the lower platens 45 arrive at their lowered position, at which time limit switches LS-20 and LS-21 will be tripped to close contacts R-40*b* and R-41*b*. This results in the energization of relay R-52 (FIG. 21) which closes normally-open contacts R-52*a* and R-52*b*, the latter of which is in a holding circuit for relay R-52. The closure of normally open relay contacts R-52*a* (FIG. 22) energizes solenoid S-7 of solenoid valve SV-7 to operate cylinder 191 to move the discharge unit down to its lowered position, permitting the tie on the feed unit 11 to gravitate down to the end-plating station 13. The fact that the feed unit has moved to its raised position prior to the descent of the discharge unit enables another tie to be fed to the end-plating station as quickly as possible.

On arrival at the end-plating station, the tie trips limit switch LS-10 which, as described above, opens relay contacts R-22*b*. This deenergizes relay 50 and solenoid S-6 of valve SV-6 which causes the feed unit to swing back down to its lowered position, enabling another tie on the infeed conveyor to move to the end-plating station. The actuation of switch LS-10 also initiates the pressing cycle, with the lower platens 45 lifting the tie at the end-plating station into the pressing chamber. The discharge conveyor remains in its lowered position until the pressure exerted by the side platens is sufficient (e.g., 1300 psi) to actuate pressure switch PS-1, which results in the opening of normally-closed contacts R-27*a* (FIG. 21) in the circuit for relay R-52, thereby deenergizing the relay and solenoid S-7 of valve SV-7 (FIG. 22) to permit the discharge unit to return to its normally-raised position. As described above, the feed unit 11 then moves to its raised position, with the tie thereon engaging the back end of the discharge unit 15.

If detectors 171 fail to detect a nailing plate on either end of a tie at the feed station 9, the operation of the end-plating apparatus is identical to that described above except that when the tie gravitates down the feed unit to the end-plating station and trips limit switch LS-10, the lower platens 45 remain at their lowered position (since relay contacts R-48*a* stay open and thus prevent the energization of relay R-23 (FIG. 19) and solenoid S-3A of valve SV-3) and the discharge unit 15 immediately swings up to its normally-raised position (since relay contacts R-22*a* and R-48*c* are open to prevent energization of relay R-52 and solenoid S-7 of valve SV-7), thereby enabling the defectively-plated tie to exit from the press. When the discharge unit reaches its raised position, it trips limit switch LS-24. As described above, this triggers the upward movement of the walking beam feed unit 11 (which had previously moved back down to its lowered position on actuation of switch LS-10 at the end-plating station) to lift another tie at the feed station into a position in which it engages the back end of the discharge unit. When the feed unit reaches its upper position, tripping limit switch LS-25, relay R-52 and solenoid S-7 of valve SV-7 are energized to operate cylinder 191 to move the discharge unit back down to its lowered position, enabling the tie on the feed unit to gravitate down to the end-plating station.

To enable the nailing plates NP to be properly and efficiently tacked onto the ties, it is desirable that a number of ties be permitted to back up from the feed station on the infeed conveyor. Accordingly, a manually-operable (e.g., pushbutton) switch PB-3 is provided for overriding limit switch LS-23 at the feed station and thereby preventing the feed unit from feeding a tie into the press. More specifically, the actuation of switch PB-3 energizes relay R-53 for opening normally-closed contacts R-53*a* to ensure that relay R-50 and solenoid S-6 of valve SV-6 remain deenergized to maintain the feed unit in its down position.

Figure 18:
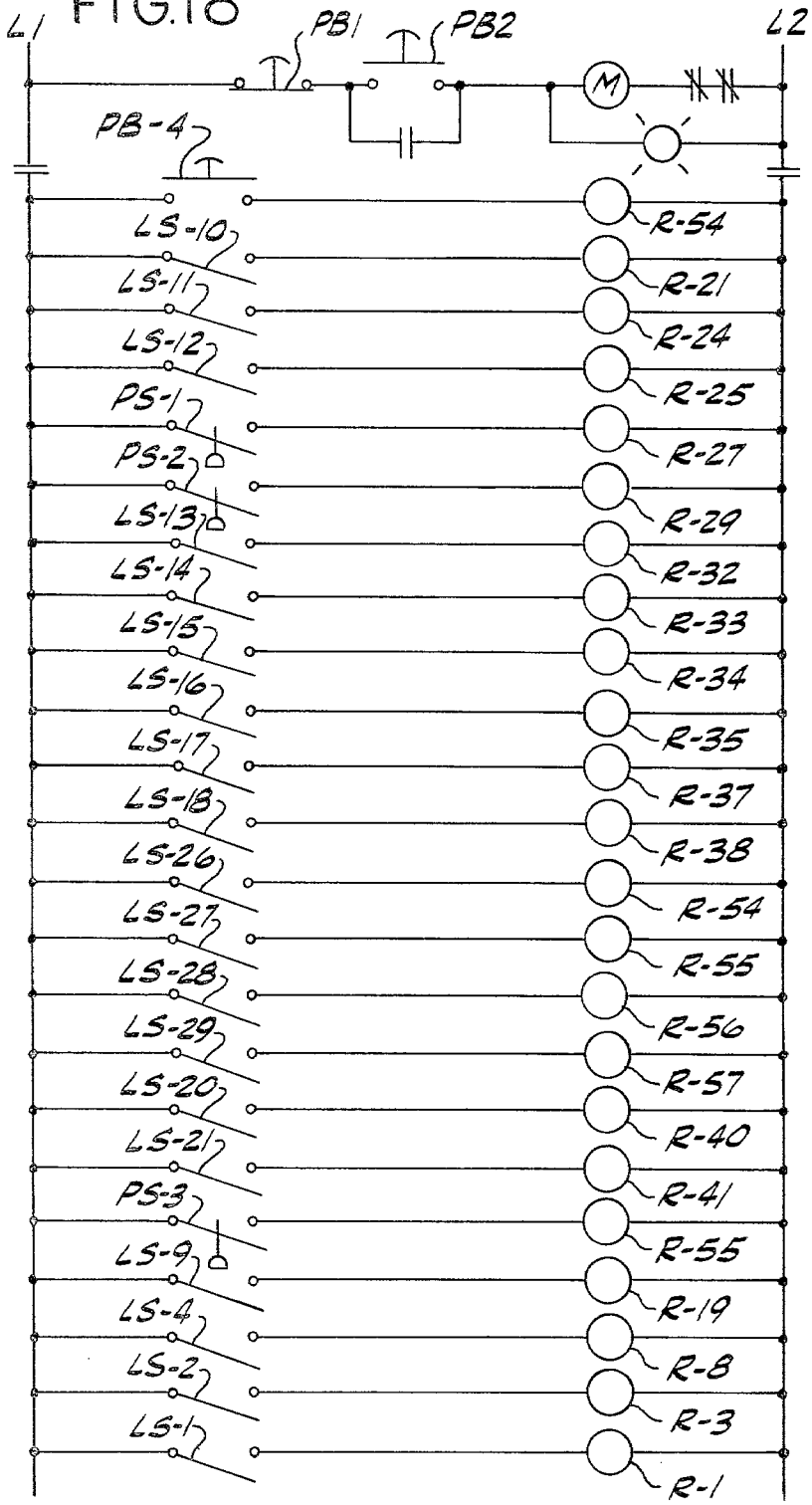
FIGS. 18–22 are diagrams of the electrical circuitry of the present invention.

In accordance with the present invention safety bars 231 are mounted on the lower flanges of channel beams 37 at opposite sides of the pressing chamber 41. When one or more of these safety bars are pressed upwardly, as by a misaligned tie being lifted by the lower platens 45, for example, one or more switches LS-26–LS-29 are tripped (FIG. 18). This energizes one or more corresponding relays R-54–R-57 to close corresponding normally-open contacts R-54*a*–R-57*a* in lines connected in parallel to relay R-30 (FIG. 19) for energizing the latter to open normally-closed contacts R-30*a*–R-30*d* and to close normally-open contacts R-30*e*–R-30*h*. This immediately causes the side and end platens 75, 95 to move to their retracted positions (if they are not already there), the lower platens 45 to descend, and the discharge unit 15 to move to its raised position for discharging the tie from the press. When the discharge unit reaches its raised position the feed unit 11 with a tie thereon swings up. The discharge unit then swings down, enabling a new tie to gravitate down to the end-plating station 13.

A manually-operable (e.g., pushbutton) switch PB-4 is also provided to stop the pressing cycle in the case of an emergency (FIG. 18). When actuated, this switch energizes a relay R-54 to close contacts R-54*a* (FIG. 19). This energizes relay R-30. From this point on, the sequence is the same as that described above in regard to the safety bars 231.

To minimize the power requirements of the end-plating apparatus and yet maximize the speed at which the cylinders of the machine extend and retract, two pumps are utilized, one being a high-volume low-pressure pump P1 and the other being a low-volume high-pressure pump P2. Both of these pumps operate together when the pressure requirements of the system are relatively low (e.g., less than 500 psi). In this connection it will be observed that cylinders 143, 163, 191 and 217 controlling the operation of the walking beam units 29, 11, 15 and the centering mechanism 25 operate at a relatively low pressure (e.g., 125 psi) which is set by a safety relief valve RV-1. Two additional pressure relief valves RV-2 and RV-3 (under the control of solenoids S-8 and S-9, respectively) are also provided. When solenoids S-8 and S-9 are deenergized, these two relief valves function to maintain the maximum system pressure at a relatively low level (e.g., 125 psi). However, when relay contacts R-22*a* are closed, indicating the presence of a tie at the end-plating station 13, and contacts R-48*b* are closed, indicating the presence of a nailing plate on at least one end of the tie, solenoids S-8 and S-9 of relief valves RV-2 and RV-3 are energized to permit the supply of fluid from the pumps at higher pressures. Both pumps continue to operate together until the pressure requirements of the system exceed a relatively high level (e.g., 500 psi), indicating that compressing forces are being applied to a tie in the pressing chamber, at which point pressure switch PS-3 closes to energize relay R-55 to open normally-closed contacts R-55*a*. This deenergizes solenoid S-8 which operates relief valve RV-2 to direct flow from the low-pressure high-volume pump P1 to reservoir R. When the pressure falls below 500 psi, switch RS-3 opens to again energize solenoid S-8 to direct flow from pump P-1 back to the press cylinders. In the event the system pressure reaches an unacceptably high level (e.g., 2150 psi), relief valve RV-3 mechanically operates to direct the flow from pump P2 back to reservoir R.

It will be apparent from the foregoing that the end-plating apparatus of the present invention is operable to end-plate ties at a relatively high rate of speed (e.g., 7 per minute), that it is safe to use, and that it is fully automatic in operation. In will also be understood that while the electrical circuitry described above incorporates mechanical relays and the like, equivalent solid state components may also be suitably used to perform the same function.

It is further contemplated that the end-plating apparatus 1 may be used to press nailing plates in the top and side faces of a tie by lightly applying (e.g., tacking on) nailing plates to the tie at these locations for engagement by the upper and side platens 65, 75.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for pressing nailing plates into opposite ends of elongate members, such as wooden railroad ties, thereby to end-plate the ties, comprising a press having upper and lower platen means engageable with the top and bottom faces of a tie adjacent the ends thereof, said lower platen means being movable through an upstroke for raising the tie while generally horizontal from a lowered position to an elevated position and for pressing the tie against said upper platen means thereby to apply a vertical compressing force to the tie adjacent the ends thereof, and a downstroke for lowering the tie, side platen means engageable with opposite side faces of said tie adjacent the ends thereof when the tie is in said elevated position, said side platen means being movable toward and away from one another whereby a horizontal compressing force can be applied to and removed from the opposite side faces of the tie adjacent the ends thereof, and a pair of end platens engagable with nailing plates on opposite ends of the tie for pressing the plates into the tie ends when the tie is in said elevated position and while said compressing forces are being applied to the tie by said upper, said lower and said side platen means.

2. Apparatus as set forth in claim 1 wherein each end platen of said pair of end platens is movable toward a respective end of the tie whereby said nailing plates may be pressed into the tie ends without substantially moving the tie along its axis when in said elevated position.

3. Apparatus as set forth in claim 1 further comprising first power means for moving said lower platen means toward and away from said upper platen means, second power means for moving said side platen means toward and away from one another, and third power means for moving said end platens toward and away from one another along a generally horizontal axis, said side platen means being adapted to center said tie on said axis prior to actuation of said third power means to move said end platens toward one another to press said nailing plates into the tie ends.

4. Apparatus as set forth in claim 3 wherein said axis lies generally in the central vertical plane of the press.

5. Apparatus as set forth in claim 3 further comprising means responsive to a tie on said lower platen means being raised to a position adjacent said upper platen means for halting upward movement of said lower platen means prior to application of said vertical compressing force to the top and bottom faces of the tie, and for actuating said second power means to move said side platens toward one another to center the tie on said axis.

6. Apparatus as set forth in claim 5 wherein said means comprises a switch mounted adjacent said upper platen means for actuation by the upward movement of a tie on said lower platen means.

7. Apparatus as set forth in claim 5 further comprising means responsive to said side platen means applying a horizontal compressing force to opposite sides of said tie for actuating said first power means to move said lower platen means toward said upper platen means to apply said vertical compressing force to the top and bottom faces of the tie.

8. Apparatus as set forth in claim 1 further comprising infeed conveyor means for conveying a series of ties one after another in generally horizontal position and with the ties extending generally transversely with respect to the direction of conveyance to a station, constituting a feed station, adjacent the press, and means for feeding the ties forward one at a time from said feed station to a station, constituting an end-plating station, in the press.

9. Apparatus as set forth in claim 8 further comprising means engageable by the leading tie as it is conveyed forwardly by said infeed conveying means for stopping the tie at said feed station.

10. Apparatus as set forth in claim 8 further comprising means adjacent said infeed conveyor means for detecting nailing plates on the ends of ties being fed to said end-plating station, said means being responsive to the absence of a nailing plate on the end of a tie being fed to said end-plating station for preventing the upstroke of said lower platen means thereby to enable immediate removal of the tie from the end-plating station.

11. Apparatus as set forth in claim 8 further comprising power means for moving said lower platen means toward and away from said upper platen means, and means responsive to the arrival of a tie at said end-plating station for actuating said power means for moving said lower platen means upwardly toward said upper platen means, said lower platen means being engageable with the bottom face of the tie for raising it and clamping it against the upper platen means thereby to apply said vertical compressing force to the tie, said power means being operable after said tie has been end-plated for moving said lower platen means and said tie thereon downwardly.

12. Apparatus as set forth in claim 8 further comprising means for centering the ties transversely with respect to the infeed conveyor means as they are conveyed to said feed station.

13. Apparatus as set forth in claim 12 wherein said centering means comprises a pair of levers mounted on opposite sides of said infeed conveyor means for pivotal movement about generally horizontal axes generally parallel to the longitudinal centerline of said infeed conveyor means and spaced substantially equidistantly from said centerline on opposite sides thereof, and means for simultaneously pivoting said levers from a first position in which they are clear of the ends of a tie and a second position in which they are engageable with the ends of the tie for centering it transversely with respect to the infeed conveyor means.

14. Apparatus as set forth in claim 13 wherein said pivot means comprises a rotary member mounted between said levers below said infeed conveyor means for rotation about a generally horizontal axis substantially parallel to said longitudinal centerline of said infeed conveyor means, and a pair of links interconnecting said rotary member and said levers, each link being pivotally connected at one end to the rotary member and at its other end to a respective lever, with said pivotal connections between said links and said rotary member being on diametrically opposite sides of said generally horizontal axis of rotation, whereby on rotation of the rotary member in one direction said levers are adapted to move toward said first position and on rotation of the rotary member in the other direction said levers are adapted to move toward said second position.

15. Apparatus as set forth in claim 12 further comprising means for stopping said ties as they are fed forward by said infeed conveyor means at a dwell station upstream of said feed station, and means for transferring said ties forward one at a time from said dwell station to a centering station where said centering means is adapted to center each tie transversely with respect to said infeed conveyor means, the centered tie then being adapted to be transferred back onto said infeed conveyor means for conveyance to said feed station.

16. Apparatus as set forth in claim 1 wherein said upper, lower and side platen means are operable in unison to apply substantially simultaneous and equal compressing forces to said top, bottom and side faces of a tie.

17. Apparatus as set forth in claim 1 wherein said upper platen means is mounted in fixed position.

18. Apparatus as set forth in claim 1 wherein said press comprises a base and a main frame of generally inverted U-shape, having two sides extending up from the base and a top, the latter having an elongate pressing chamber therein extending substantially from one side of the frame to the other and having an open bottom for receiving a tie as it is raised by said lower platen means toward said upper platen means, the upper platen means being disposed for engagement by a tie in said chamber.

19. Apparatus as set forth in claim 18 wherein said end platens are mounted on the sides of said main frame at opposite ends of said pressing chamber.

20. Apparatus as set forth in claim 18 wherein said side platen means comprises two pairs of side platens mounted on said top of said main frame at opposite sides of said pressing chamber for engagement with opposite sides of a tie in the pressing chamber.

21. Apparatus as set forth in claim 1 further comprising a plurality of hydraulic cylinder units for moving said lower platen means, said side platen means and said end platens, and pump means for supplying each unit with hydraulic fluid at a relatively high rate until the force exerted by the unit exceeds a predetermined force, and for supplying each unit with hydraulic fluid at a lower rate when the force exerted by the unit exceeds said predetermined force.

22. Apparatus as set forth in claim 1 further comprising outfeed conveyor means for conveying an end-plated tie from the press.

23. Apparatus as set forth in claim 1 wherein each end platen comprises a base having a circular recess therein constituting a socket, said socket having a peripheral wall with a predetermined radius of curvature, and a platen member mounted in said socket for rotational movement with respect to said base about a point constituting a point of gyration, said platen member having an inner rounded surface with a radius of curvature substantially identical to the radius of curvature of said socket wall for providing a relatively close swivel fit between said rounded surface and said socket wall, and an outer pressing surface engageable with a nailing plate on a respective tie end for embedding the nailing plate in the tie end, the platen member being dimensioned such that said point of gyration lies substantially on said pressing surface.

24. Apparatus as set forth in claim 23 further comprising means for holding said base and said platen member in assembly with the rounded surface of the platen member in said socket.

25. Apparatus as set forth in claim 24 wherein said platen member has a cenral axis and said holding means comprises spring means operable for biasing said platen member toward a position in which its central axis is coincident with the central axis of said socket.

26. Apparatus as set forth in claim 25 wherein said spring means comprises a plurality of springs interconnecting said base and said platen member.

27. Apparatus as set forth in claim 23 wherein said pressing surface is generally planar.

28. Apparatus as set forth in claim 23 wherein said end platens are movable toward one another along a generally horizontal axis coincident with the central axis of said socket and extending through said point of gyration.

* * * * *